US012571169B2

(12) United States Patent
Farr et al.

(10) Patent No.: US 12,571,169 B2
(45) Date of Patent: Mar. 10, 2026

(54) POWERTRAIN FOR PAVING MACHINE

(71) Applicant: GOMACO Corporation, Ida Grove, IA (US)

(72) Inventors: Thomas C Farr, Ida Grove, IA (US); Lex Jacobson, Battle Creek, IA (US); Andrew Lundy, Ida Grove, IA (US); Mark W Brenner, Ida Grove, IA (US)

(73) Assignee: GOMACO Corporation, Ida Grove, IA (US)

( * ) Notice: Subject to any disclaimer, the term of this patent is extended or adjusted under 35 U.S.C. 154(b) by 969 days.

(21) Appl. No.: 17/745,679

(22) Filed: May 16, 2022

(65) Prior Publication Data

US 2022/0389666 A1 Dec. 8, 2022

Related U.S. Application Data

(60) Provisional application No. 63/197,667, filed on Jun. 7, 2021.

(51) Int. Cl.
*E01C 19/48* (2006.01)

(52) U.S. Cl.
CPC ..... *E01C 19/4893* (2013.01)

(58) Field of Classification Search
CPC ..... E01C 19/4893
(Continued)

(56) References Cited

U.S. PATENT DOCUMENTS 3,901,616 A * 8/1975 Greening ..... E01C 19/4873 404/85
3,920,349 A 11/1975 Jennings et al.
(Continued)

FOREIGN PATENT DOCUMENTS

CN 201901012 U 7/2011
CN 106480808 B 11/2018
(Continued)

OTHER PUBLICATIONS

Cunanan, et al., (2021). A Review of Heavy-Duty Vehicle Powertrain Technologies: Diesel Engine Vehicles, Battery Electric Vehicles, and Hydrogen Fuel Cell Electric Vehicles. Clean Technologies. 3. 474-489. 10.3390/cleantechnol3020028.
(Continued)

*Primary Examiner* — Raymond W Addie
(74) *Attorney, Agent, or Firm* — Suiter Swantz IP

(57) ABSTRACT

A paving machine is described. The paving machine includes a powertrain with a power unit. The power unit may include a diesel generator and a battery. The powertrain may also include one or more drivetrains. The drivetrains may include a hydraulic drivetrain and an electric drivetrain. The drivetrains may receive power from the power unit for supplying power to actuators of the hydraulic drivetrain and the electric drivetrain. The paving machine may be a curb-forming machine including the battery, the hydraulic drivetrain, and the electric drivetrain. The hydraulic drivetrain of the curb-forming machine may include a cylinder, crawler, steering assembly, and auger, and the electric drivetrain may include a vibrator. The paving machine may also include a number of other types of paving machines. Where the paving machine includes the hydraulic drivetrain, a buffer may be provided to ensure sufficient hydraulic power in response to demand changes.

17 Claims, 25 Drawing Sheets

(58) Field of Classification Search
USPC ..... 404/84.05–84.8, 105, 118, 72
See application file for complete search history.

(56) References Cited

U.S. PATENT DOCUMENTS

| | | | | |
|---|---|---|---|---|
| 4,266,917 | A | 5/1981 | Godbersen | |
| 4,566,823 | A | 1/1986 | May | |
| 4,789,266 | A | 12/1988 | Clarke, Jr. et al. | |
| 5,662,431 | A * | 9/1997 | Colvard | E01C 19/4893 404/98 |
| 7,053,568 | B2 | 5/2006 | Rudinec | |
| 7,441,987 | B1 | 10/2008 | Sampey | |
| 7,950,481 | B2 | 5/2011 | Betz et al. | |
| 8,616,310 | B2 | 12/2013 | Lopez | |
| 8,769,917 | B1 | 7/2014 | Howell | |
| 9,382,675 | B2 | 7/2016 | Frelich et al. | |
| 9,637,872 | B1 | 5/2017 | Pedersen et al. | |
| 9,764,762 | B2 | 9/2017 | Klein et al. | |
| 11,225,149 | B2 | 1/2022 | Kaneda et al. | |
| 11,254,359 | B1 | 2/2022 | Wulf | |
| 2008/0253834 | A1 * | 10/2008 | Colvard | E01C 23/163 33/290 |
| 2010/0122860 | A1 | 5/2010 | McKelvey | |
| 2012/0060461 | A1 | 3/2012 | Bergsten et al. | |
| 2014/0377002 | A1 | 12/2014 | Seever | |
| 2015/0056015 | A1 * | 2/2015 | Thieme | E01C 19/42 404/118 |
| 2015/0176252 | A1 * | 6/2015 | Kim | E02F 9/2066 701/50 |
| 2019/0308511 | A1 * | 10/2019 | Bindl | B60K 6/46 |
| 2021/0001726 | A1 | 1/2021 | Olsson | |
| 2022/0024324 | A1 | 1/2022 | Sopko, Jr. et al. | |

FOREIGN PATENT DOCUMENTS

| | | | | |
|---|---|---|---|---|
| DE | 102014012043 | A1 * | 2/2016 | E01C 19/48 |
| EP | 3686353 | A1 | 7/2020 | |
| GB | 1391157 | A | 4/1975 | |

OTHER PUBLICATIONS

Curb Cadet Compact Curb Machine Specification, Printed 2017 (2 GOMACO Corp.).

GOMACO Machinery: Full Line: English Printed in U.S.A. (2017).

Nation, Shelley et al., "Considerations for Hydraulics in Electric Off-Highway Equipment: Deployment of efficient hydraulic components and architectures can provide power saving opportunities in electric-powered heavy equipment". Retrieved from.

Quan, et al., (2021). A Survey of Powertrain Technologies for Energy-Efficient Heavy-Duty Machinery. Proceedings of the IEEE. pp. 10.1109/JPROC.2021.3051555.

World First: electric asphalt paver for BAM, Koninklijke BAM Groep/Royal Bam Group, Press Release dated Jan. 14, 2022.

* cited by examiner

308 / 314

600

600

600

802

806

808

810

812

POWERTRAIN FOR PAVING MACHINE

CROSS-REFERENCE TO RELATED APPLICATIONS

The present application claims the benefit under 35 U.S.C. Section 119(e) of U.S. Provisional Application No. 63/197,667, filed Jun. 7, 2021, which is incorporated herein by reference in the entirety.

TECHNICAL FIELD

Embodiments of the invention are directed generally toward the field of paving machines, and more particularly for powertrains of self-propelled paving machines.

BACKGROUND OF THE INVENTION

Paving machines commonly use diesel engines to directly drive a hydraulic pump for supplying a flow of hydraulic fluid to any number of hydraulic actuators. For example, Gomaco Corporation provides curb and gutter operations, slipform paving, placer spreader operations, trimmer placer operations, texture cure operations, and finishing operations by a number of paving machines utilizing such diesel engine and hydraulic circuits. Diesel engines may emit nitrogen oxides and carbon oxides. Changes in environmental policy has demonstrated a need for adapting off-highway equipment with reduced emissions. Therefore, it would be advantageous to provide a device, system, and method that cures the shortcomings described above.

SUMMARY

A paving machine is described, in accordance with one or more embodiments of the present disclosure. In one illustrative embodiment, the paving machine includes a frame. In another illustrative embodiment, the paving machine includes a powertrain. In another illustrative embodiment, the powertrain includes a power unit coupled to the frame. In another illustrative embodiment, the power unit includes at least one of a generator or one or more batteries. In another illustrative embodiment, the powertrain includes at least one of a hydraulic drivetrain or an electric drivetrain. In another illustrative embodiment, at least one of the hydraulic drivetrain or the electric drivetrain is configured to receive electric power from the power unit. In another illustrative embodiment, at least one of the hydraulic drivetrain or the electric drivetrain includes at least one subcircuit which includes one or more actuators.

A curb-forming machine is described, in accordance with one or more embodiments of the present disclosure. In one illustrative embodiment, the curb-forming machine includes a frame. In another illustrative embodiment, the curb-forming machine includes a hopper coupled to the frame and configured to receive a material to be formed. In another illustrative embodiment, the curb-forming machine includes at least one crawler assembly supporting at least a portion of the frame, the at least one crawler assembly configured to propel the frame in a direction of travel. In another illustrative embodiment, the curb-forming machine includes an auger configured to convey the material from the hopper in a direction transverse to the direction of travel. In another illustrative embodiment, the curb-forming machine includes a mold configured to form a material into a curb. In another illustrative embodiment, the curb-forming machine includes one or more batteries configured to supply power. In another illustrative embodiment, the curb-forming machine includes one or more valves configured to measure a hydraulic flow provided to the auger and the at least one crawler assembly. In another illustrative embodiment, the curb-forming machine includes an electric motor. In another illustrative embodiment, the curb-forming machine includes a pump configured to be driven by the electric motor, wherein the pump generates the hydraulic flow in response to being driven by the electric motor. In another illustrative embodiment, the curb-forming machine includes a motor controller configured to receive the power from the battery and selectively engage the electric motor to drive the pump based on the hydraulic flow measured by the one or more valves.

A method is described, in accordance with one or more embodiments of the present disclosure. In one illustrative embodiment, the method includes calculating a desired flow rate of hydraulic fluid output by a hydraulic pump based on one or more inputs. In another illustrative embodiment, the one or more inputs include at least one of travel speed, an auger speed, or a trimmer speed. In another illustrative embodiment, the desired flow rate includes a buffer. In another illustrative embodiment, the method includes receiving feedback from at least one sensor. In another illustrative embodiment, the at least one sensor indicates a spool position for a bank of valves. In another illustrative embodiment, the method includes controlling a revolutions per minute of an electric motor to output the desired flow rate of the hydraulic fluid based on the feedback from the at least one sensor. In another illustrative embodiment, the spool position for the bank of valves is summed to determine an actual hydraulic flow rate through the bank of valves which is used to control the revolutions per minute.

Further Contemplations:

A curb-forming machine is described, in accordance with one or more embodiments of the present disclosure. In one illustrative embodiment, the curb-forming machine includes a frame. In another illustrative embodiment, the curb-forming machine includes a hopper coupled to the frame and configured to receive a material to be formed in a shape. In another illustrative embodiment, the curb-forming machine includes at least one crawler assembly supporting at least a portion of the frame. In another illustrative embodiment, the at least one crawler assembly is configured to propel the frame in a direction of travel. In another illustrative embodiment, the curb-forming machine includes an auger configured to convey the material from the hopper transversely to the direction of travel. In another illustrative embodiment, the curb-forming machine includes a battery configured to supply an electrical power. In another illustrative embodiment, the curb-forming machine includes a motor controller configured to control an amount of power supplied from the battery to an electrical motor of the at least one crawler assembly and an electrical motor of the auger.

BRIEF DESCRIPTION OF THE DRAWINGS

Implementations of the concepts disclosed herein may be better understood when consideration is given to the following detailed description thereof. Such description refers to the included drawings, which are not necessarily to scale, and in which some features may be exaggerated, and some features may be omitted or may be represented schematically in the interest of clarity. Like reference numerals in the drawings may represent and refer to the same or similar element, feature, or function. In the drawings.

DETAILED DESCRIPTION OF THE INVENTION

Figure 1:
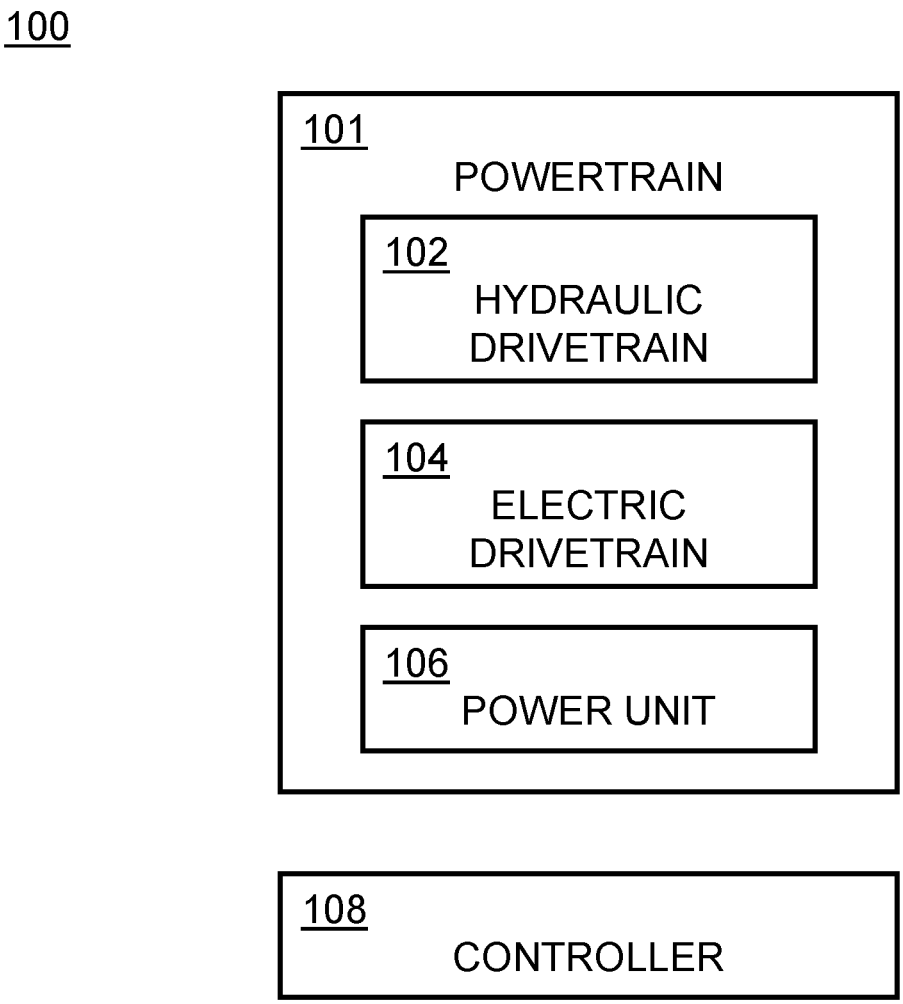
FIG. 1 depicts a simplified block diagram of a paving machine including a powertrain, in accordance with one or more embodiments of the present disclosure.

Before explaining one or more embodiments of the disclosure in detail, it is to be understood that the embodiments are not limited in their application to the details of construction and the arrangement of the components or steps or methodologies set forth in the following description or illustrated in the drawings. In the following detailed description of embodiments, numerous specific details may be set forth in order to provide a more thorough understanding of the disclosure. However, it will be apparent to one of ordinary skill in the art having the benefit of the instant disclosure that the embodiments disclosed herein may be practiced without some of these specific details. In other instances, well-known features may not be described in detail to avoid unnecessarily complicating the instant disclosure.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only and should not be construed to limit the disclosure in any way unless expressly stated to the contrary.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of "a" or "an" may be employed to describe elements and components of embodiments disclosed herein. This is done merely for convenience and "a" and "an" are intended to include "one" or "at least one," and the singular also includes the plural unless it is obvious that it is meant otherwise.

Finally, as used herein any reference to "one embodiment", "in embodiments", or "some embodiments" means that a particular element, feature, structure, or characteristic described in connection with the embodiment is included in at least one embodiment disclosed herein. The appearances of the phrase "in some embodiments" in various places in the specification are not necessarily all referring to the same embodiment, and embodiments may include one or more of the features expressly described or inherently present herein, or any combination or sub-combination of two or more such features, along with any other features which may not necessarily be expressly described or inherently present in the instant disclosure.

Reference will now be made in detail to the subject matter disclosed, which is illustrated in the accompanying drawings. Embodiments of the present disclosure are generally directed to one or more powertrains for a paving machine. The powertrain may include a power unit such as a diesel generator and/or one or more batteries. The powertrain may also include a hydraulic drivetrain including an electric motor and a hydraulic pump which receives electrical power from the power unit and provides hydraulic power to one or more hydraulic circuits of the paving machine. Where the paving machine includes the hydraulic circuit, a buffer of excess hydraulic fluid may be provided to accommodate a need for instantaneous changes in power. The powertrain may also include one or more electric drivetrains which provide electrical power from the power unit to one or more electric circuits. The paving machine may achieve a sufficient number of operational hours while meeting or exceeding emissions requirements by the selection of the diesel generator, battery, hydraulic drivetrain, and/or the electric drivetrain.

Referring now to FIG. 1, a paving machine 100 is described, in accordance with one or more embodiments of the present disclosure. As used herein, the paving machine 100 may generally refer to any kind of paving machine, such as, but not limited to, curb forming equipment, slipform pavers (e.g., two-track slipform pavers, three-track slipform pavers, four-track slipform pavers), placing machines, spreading machines, trimming machines, milling machines, texturing machines, finishing machines, bridge deck machines, and the like.

The paving machine 100 may include a powertrain 101. The powertrain 101 of the paving machine 100 may be subject to a number of design considerations. A first design consideration may include the paving environment, which commonly includes dirt, dust, concrete, water, vibrations, and human factors. Another design consideration is the torque requirements for the various drives of the paving machine 100. Another design consideration includes compliance with any number of environmental laws, treaties, regulations, industrial standards, and the like. Therefore, the powertrain 101 may be designed with a given level of robustness, safety, efficiency, power, and/or emissions.

The powertrain 101 may include, but is not limited to, a hydraulic drivetrain 102, an electric drivetrain 104, or some combination thereof. The use of the electric drivetrain 104 may provide one or more advantages when compared to the hydraulic drivetrain 102. For example, pumping hydraulic fluid in the hydraulic drivetrain 102 may result in efficiency loses, which may be substantially higher than efficiency loses of electrical lines of the electric drivetrain 104. By way of another example, the hydraulic fluid may be incompressible such that changes in demand require a delay or a buffer to accommodate the increased demand. In contrast, the electricity may be transmitted to electric actuators of the electric drivetrain 104 for providing near instantaneous torque in response to demand. Similarly, the use of the hydraulic drivetrain 102 may provide one or more advantages when compared to the electric drivetrain 104. For example, the hydraulic drivetrain 102 may provide a large force output while maintaining a small form factor. By way of another example, the hydraulic drivetrain 102 may maintain the force output at a constant value without activating the pump.

The powertrain 101 may also include a power unit 106 which is configured to supply electric power to one or more of the hydraulic drivetrain 102 or the electric drivetrain 104. The power unit 106 may include one or more of a diesel-battery power unit, a battery power unit, a diesel power unit, and the like. In this regard, the powertrain 101 may be considered a diesel-battery-powered hydraulic-driven powertrain, a battery-powered hydraulic-driven powertrain, a diesel-powered hydraulic-driven powertrain, a diesel-battery-powered electric-driven powertrain, a battery-powered electric-driven powertrain, a diesel-powered electric-driven powertrain, or some combination thereof. The power unit 106 may be mounted to a frame 110 (also referred to herein as a framework) of the paving machine.

Although not depicted, the powertrain 101 may further include one or more inverters for converting between direct current and alternating current, as appropriate.

The paving machine 100 may also include a controller 108. The controller 108 may also be referred to herein as a machine controller or a primary controller. The controller 108 may be configured to receive one or more inputs and selectively control the powertrain 101 based on the one or more inputs. In some instances, the controller 108 controls the powertrain 101 by communicating with one or more motor controllers of the powertrain 101, such as by a controller area network (CAN) bus.

Figure 2A:
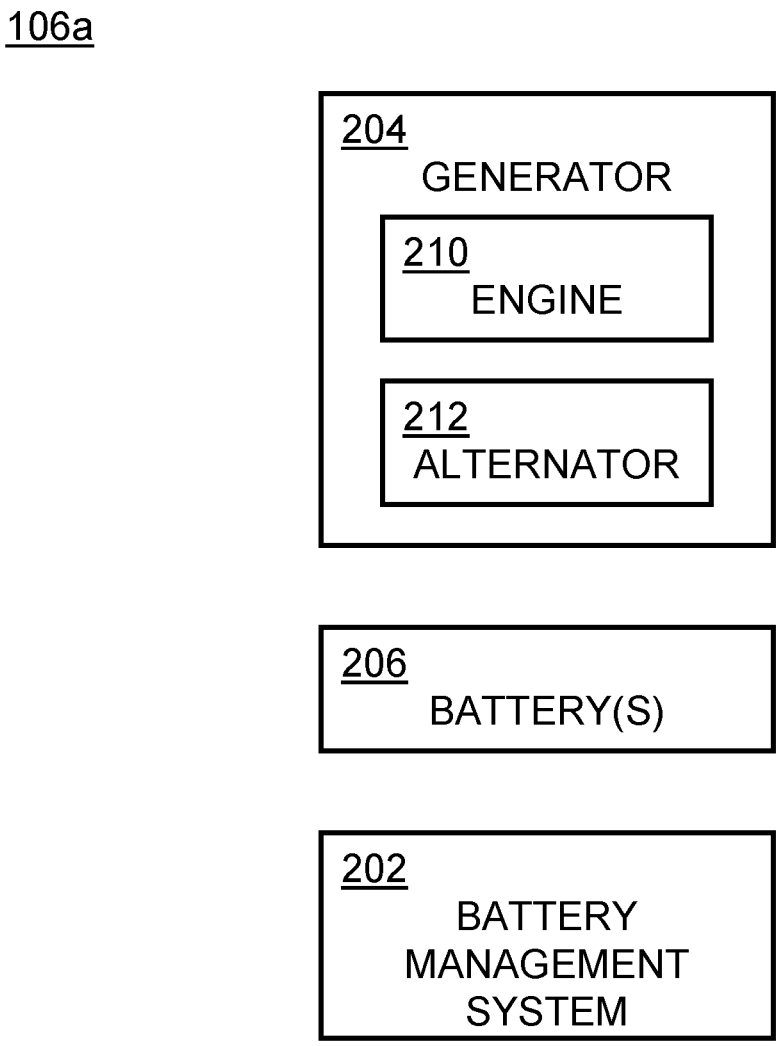
FIG. 2A depicts a simplified block diagram of a power unit of powertrain including a generator and one or more batteries, in accordance with one or more embodiments of the present disclosure.
Figure 2B:
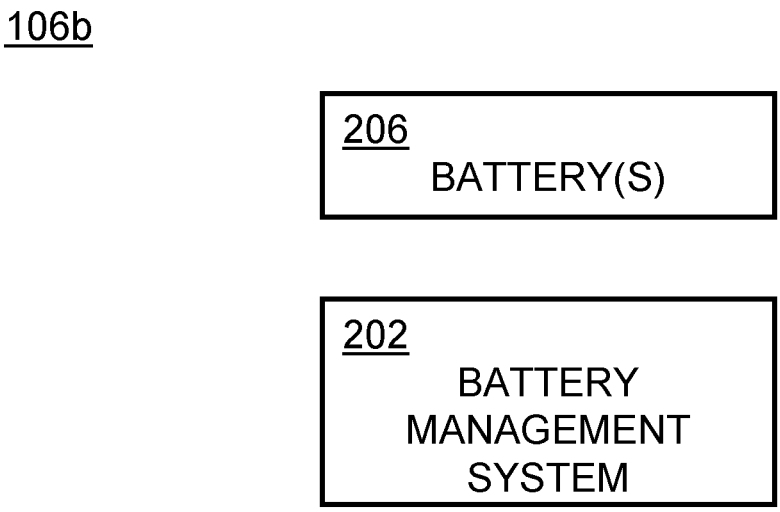
FIG. 2B depicts a simplified block diagram of a power unit of powertrain including one or more batteries, in accordance with one or more embodiments of the present disclosure.
Figure 2C:
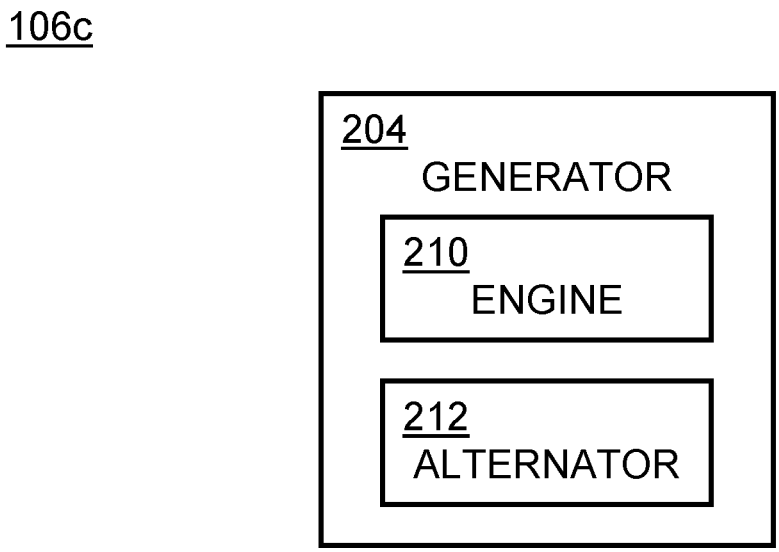
FIG. 2C depicts a simplified block diagram of a power unit of powertrain including a generator, in accordance with one or more embodiments of the present disclosure.

Referring generally to FIG. 2A-2C, the power unit 106 is described, in accordance with one or more embodiments of the present disclosure. The power unit 106 may be an electric power source for the paving machine 100. Providing the power unit 106 as an electric power source may provide a number of benefits. For example, the paving machine 100 may comply with any number of environmental laws, treaties, regulations, industrial standard, and the like which may be set forth by any country, state, agency, regulatory body, industrial standards board, and the like, such as, but not limited to Tier 4 emission standards according to the Environmental Protection Agency, Stage V emission standards according to the European emission standards, and the like.

The power unit 106 may include a generator 204 and/or one or more batteries 206. Where the power unit 106 includes the battery 206, the power unit 106 may also include a battery management system 202.

The generator 204 may generally include any number of components, such as, but not limited to, an engine 210 and an alternator 212. A power of the engine 210 may be selected based on a number of factors, such as, but not limited to, a power of the battery 206 and a power requirement of the paving machine 100. The engine 210 may be a diesel engine, a gasoline engine, compressed natural gas engine, or the like. As used herein, the engine 210 may also be referred to as a diesel engine and the generator 204 may also be referred to as a diesel generator, although this is not intended to be limiting.

The battery 206 may generally include any type of battery, such as, but not limited to, lithium-ion batteries, lead-acid batteries, nickel-metal hydride, a supercapacitor, and the like. The battery 206 may also refer to one or more batteries which are connected together. The batteries may be connected in series, in parallel, or some combination thereof to achieve a desired voltage and capacity. In some instances, the use of the battery may increase a weight of the paving machine. The framework of the paving machine may include sufficient rigidity to support the additional weight. A weight of a battery powered paver may be reduced below a comparable diesel-powered paver with advances in power density of battery technology. In some instances, the battery 206 may be a high voltage battery (e.g., 70 volts or more). For example, the battery 206 may include a voltage of 350 volts, or more. Increasing the voltage of the battery may be advantageous in reducing a size of the battery, providing a higher power output, and/or meeting a desired capacity. However, the use of high voltages in the context of the paving machine 100 may provide a number of challenges, such as introducing a danger of electrocution for human operators and requiring electrical certification when performing maintenance depending upon the voltage level.

One challenge with implementing high voltage batteries in the paving machine 100 is guarding human users from the battery 206. In some instances, the battery 206 may be considered a smart battery which includes or is coupled to the battery management system 202, or the like. The battery management system 202 may switch power to terminals of the battery 206 when the circuit is on and switch power away from the terminals when the circuit is off. For example, terminals of the battery 206 may be turned off when the paving machine 100 is turned off (e.g., by key, emergency stop, or the like). The battery management system 202 may be advantageous for deenergizing the batteries 206 of the paving machine 100 thereby improving safety, such as during routine maintenance, thereby reducing a danger of the battery.

In embodiments, the battery management system 202 may be configured to determine a state of charge for the battery 206. The state of charge may then be used to compute a remaining amount of paving time for the paving machine 100. For example, the remaining amount of paving time may be computed based on the state of charge, an expected rate of discharge, an actual rate of discharge, and the like. For example, the battery management system 202 may determine an amount of charge (e.g., amp-hour) for the paving machine 100 fora given amount of time, such as, but not limited to, an hour. In some instances, the battery management system may determine the amount of charge at preset intervals, such as, but not limited to, every 3 minutes. The battery management system 202 may then compute an amount of paving time to a given amount of charge or capacitance after a given amount of preset intervals have been received, such as, but not limited to, two of the three-minute intervals corresponding to six minutes. The given amount of charge may indicate the battery is low, such as, but not limited to, at 15 percent. The time estimate may be determined based on the current state of charge together with the battery usage over time. Providing the time estimate to the low battery may be advantageous in allowing paving operators to determine how many more hours and minutes of paving may occur before the machine should be moved to a charger. In embodiments, the battery management system 202 may place the paving machine 100 into standby mode once a threshold is reached, thereby causing the paving operator to see the battery is low prior to resuming paving.

A location of the battery is now described. The frame 110 of the paving machine 100 may house the battery. The battery may be coupled to one or more locations of the framework. In embodiments, the battery may be placed on the framework based on a center of gravity of the paving machine 100, such that a stability of the paving machine may be maintained throughout all phases of operation thereby reducing a likelihood of rollover of the paving machine. For example, in a diesel-battery power unit a size of the diesel generator may be reduced with the battery occupying the remaining space. By way of another example, in a battery power unit the battery may replace the diesel generator and the hydraulic reservoir.

As depicted in FIG. 2A, the power unit may include both of the generator 204 and one or more the batteries 206, such that the power unit may be considered a diesel-battery power unit 106*a*. The battery 206 may be provided to improve an efficiency of the power unit 106. The generator 204 may include the engine 210 and the alternator 212. A major component in an efficiency of the generator 204 is the engine 210. Commonly, diesel engines may include a range of RPMs at which the engine achieves a peak torque, powerband, or efficiency. The engine may then be selected to achieve maximum efficiency based on the average power requirements.

It is contemplated that there may be a number of permutations for the generator 204 and the battery 206. For example, the generator 204 may be considered a primary power source with the battery 206 acting as a secondary battery source depending upon power needs. By way of another example, the battery 206 may be considered a primary power source with the generator 204 acting as a secondary power source. By way of another example, each of the generator 204 and the battery 206 may be a primary power source.

In embodiments, the generator 204 may be used as a primary power source for the paving machine 100 and the battery 206 may be used as a secondary power source. By using the generator 204 as the primary power source, the generator 204 may constantly run at full power during the paving process. When the generator 204 is unable to provide sufficient electric power during peak loads, the battery 206 may supplement the electric power. The engine of the generator may then be selected with an efficiency which is maximized at the maximum power output of the generator, instead of trying to maximum the efficiency of the generator across a wide range of power outputs. The generator may be sized to provide sufficient electric power for primary functions of the paving machine, such as steering, height control, travel speed, auger, vibrators, and the like. The battery may then provide electric power during peak loads. The peak loads may occur when accessories such as a dowel bar inserter, a frame width adjuster, a conveyor, trimmer, and the like are turned on. The peak loads may also occur when the paving machine 100 encounters an object.

For example, the paving machine 100 may be a two-track, three-track, or four-track slipform paver. The slipform paver may include a basic load requirement which may be known. The slipform paver may include the diesel-battery powered unit. The diesel engine may be designed with a power band of a range of operating RPMs. Within the power band, the diesel engine may generate power at a highest efficiency. The diesel engine may be selected with a power band at which a desired amount of power may be output for normal operation. Such amount of power may be sufficient for most operations (e.g., 80 percent of operations). However, the slipform paver may intermittently require additional power. The battery may be configured to meet the intermittent requirements of the diesel engine by the battery. For instance, the slipform paver may include a trimmer circuit and/or an auger circuit. The slipform paver may require the extra power for a variety of reasons, such as when a trimmer-head of the trimmer circuit becomes stuck or when an auger of the auger circuit becomes stuck. In some instances, the trimmer circuit may use between half and three-fourths of the power of the three-track slipform paver when stuck. The peak loads may be intermittent, such as during 10 to 15 percent of normal operations when the trimmer is engaged. By providing such additional power by the battery, the diesel engine may remain operational in the most efficient power band to ensure efficiency of the power unit 106 may be improved while also allowing the trimmer to become unstuck. The controller 108 and/or one or more motor controllers may detect the trimmer or the auger has become stuck based on a signal from an encoder. The encoder may indicate the RPM of the electric motor is at or below a threshold, such as, but not limited to, a 0 RPM threshold. The controller 108 and the one or more motor controllers may then cause the battery 206 of the power unit 106 to supply additional power (e.g., to an electric motor of a hydraulic drivetrain and/or a trimmer-head motor of an electric drivetrain) causing the trimmer or the auger to become unstuck.

As may be understood, the power output of the diesel engine and the battery may be selected based on a number of factors such as a size of the paving machine. For instance, the generator may output between 60 and 65 horsepower, or more, and the battery may provide any amount of power, such as, but not limited to, between 40 and 65 horsepower, or more, although this is not intended to be limiting.

In embodiments, the generator 204 may also be configured to recharge the battery 206. For example, the generator 204 may recharge the battery 206 using otherwise unused electric power produced by the generator 204. During normal paving operations below peak demand, the diesel engine may provide some amount of excess power. The excess power of the diesel engine may be converted to electric power, for charging the electric battery (e.g., by way of an alternator). Recharging the electric battery by the diesel engine may be advantageous where diesel fuel is faster or more readily available then access to a battery recharger. Such diesel-electric hybrid power units may also address range anxiety concerns while allowing the battery to meet peak load demands which are intermittent.

As depicted in FIG. 2B, the power unit may include one or more of the batteries 206 without the generator 204, such that the power unit may be considered a battery power unit 106*b*. The battery power unit 106*b* may provide one or more benefits. For example, the paving machine 100 may pave inside of an enclosed space (e.g., tunnel, warehouse, etc.), without requiring air to be pumped into the space, due to the power unit not including the generator 204 and thereby not generating carbon oxides and nitrogen oxides.

As depicted in FIG. 2C, the power unit may include the generator 204 without the battery 206, such that the power unit may be considered a diesel-power unit 106*c* (i.e., where the generator 204 is a diesel generator). One challenge with converting the power unit from being the diesel-power unit 106*c* to either the diesel-battery-power unit 106*a* or the battery-power unit 106*b* is maintaining the cost of the paving machine at or below parity together while achieving sufficient power density. It is contemplated that future advances in battery technology may improve the power density and the cost of the battery 206. It is further contemplated that the power unit 106*c* may be useable with the powertrain 101 without a battery.

Figure 3A:
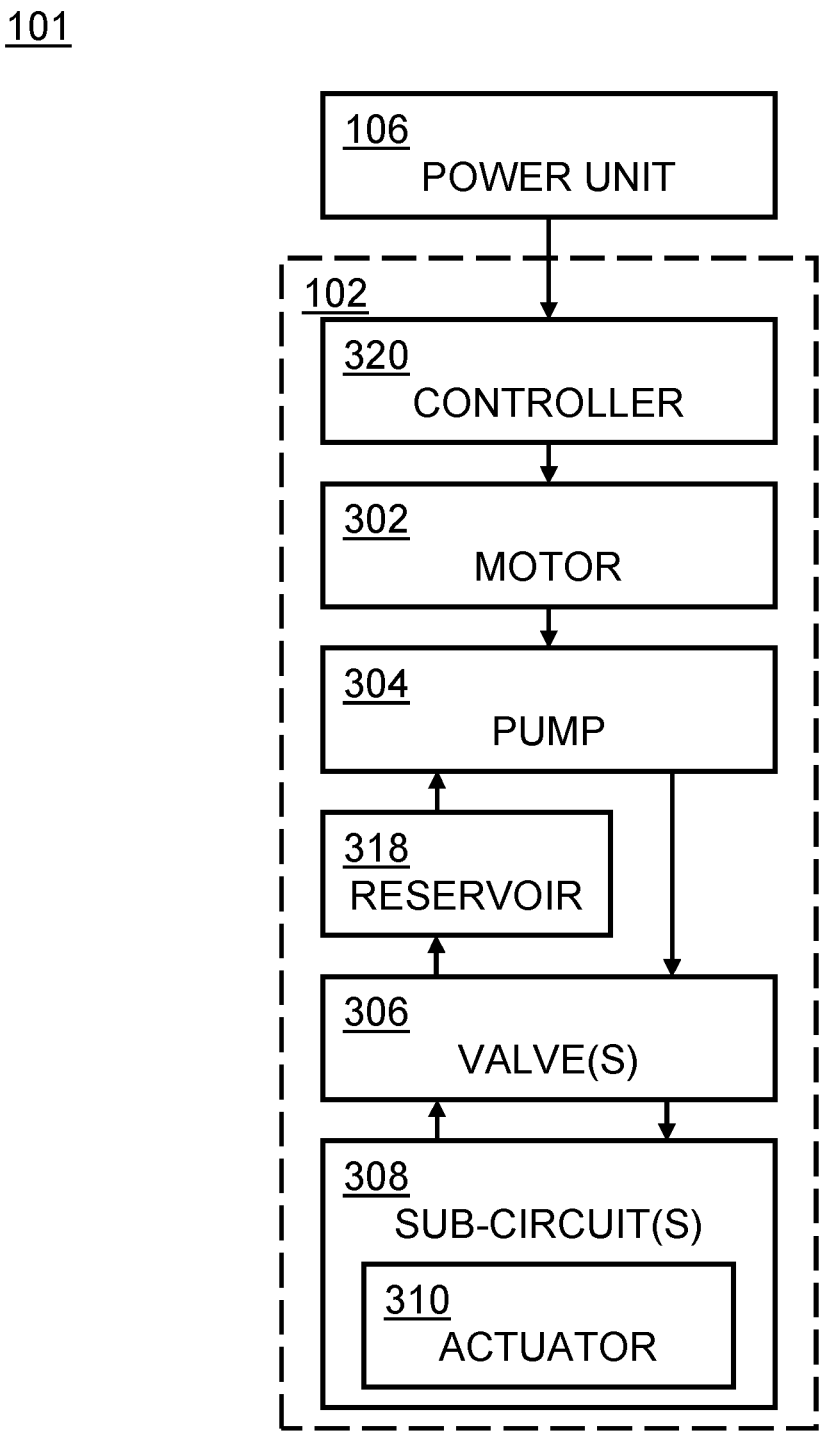
FIG. 3A depicts a simplified block diagram of a powertrain including a hydraulic drivetrain, in accordance with one or more embodiments of the present disclosure.
Figure 3B:
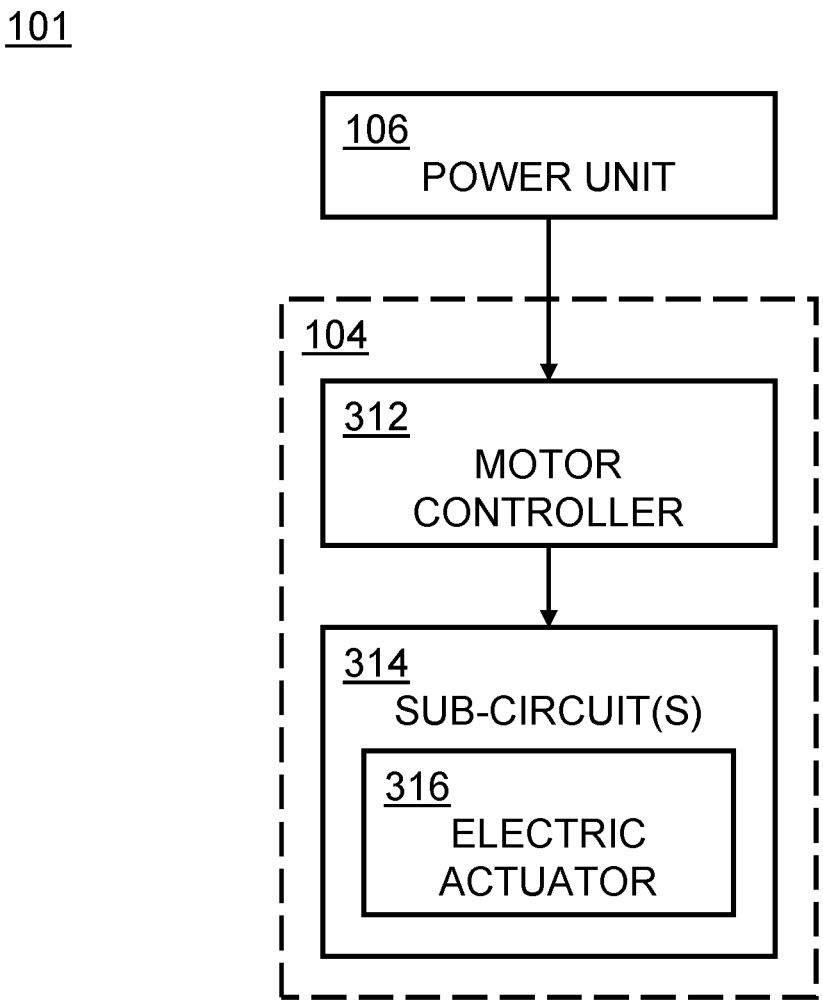
FIG. 3B depicts a simplified block diagram of a powertrain including an electric drivetrain, in accordance with one or more embodiments of the present disclosure.
Figure 3C:
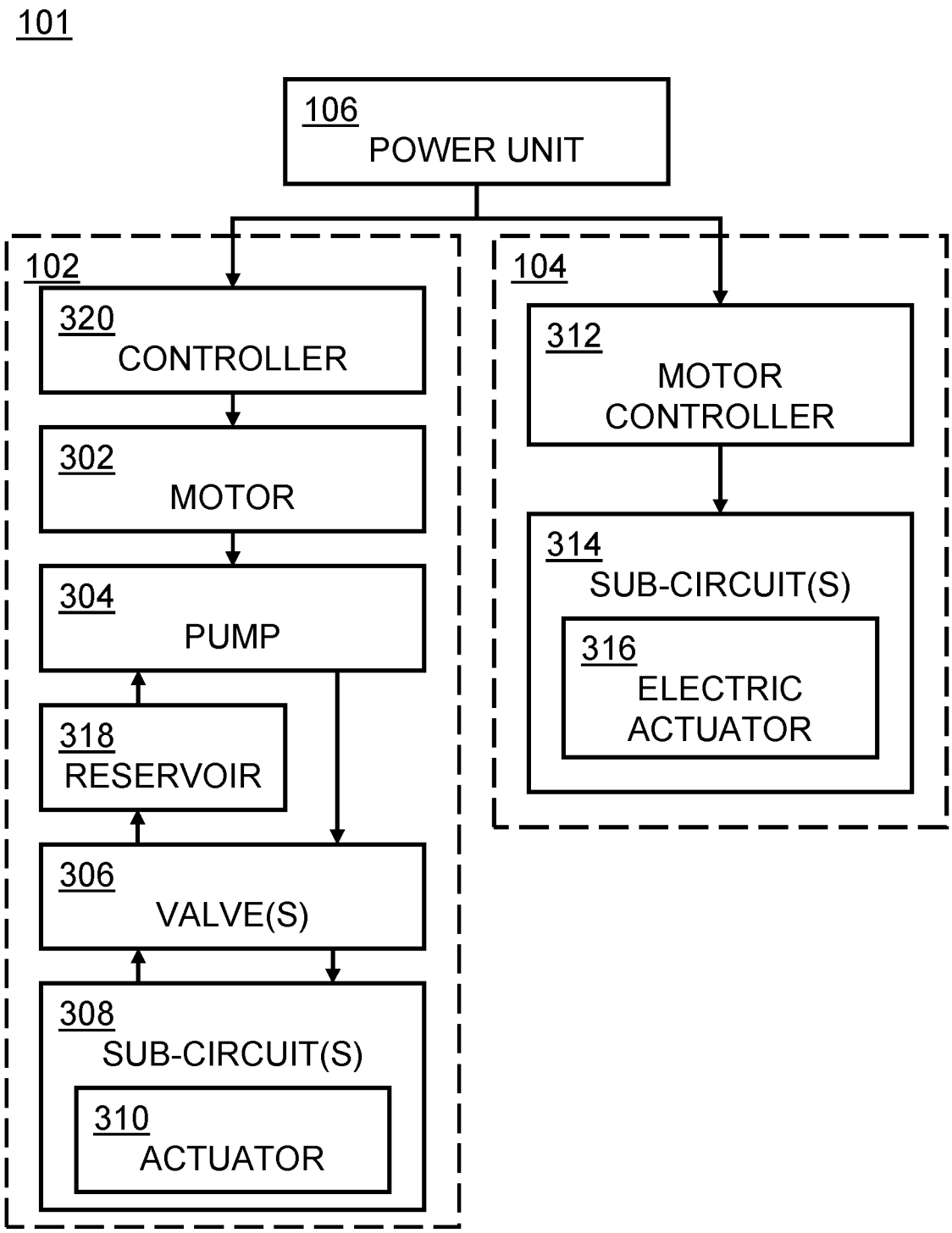
FIG. 3C depicts a simplified block diagram of a powertrain including a hydraulic drivetrain and an electric drivetrain, in accordance with one or more embodiments of the present disclosure.

Referring generally to FIG. 3A-3C, the various drivetrains of the powertrain 101 is described, in accordance with one or more embodiments of the present disclosure.

Referring now to FIG. 3A, the powertrain 101 may include the hydraulic drivetrain 102 which may be coupled to the power unit 106 for receiving power and driving one or more actuators by a hydraulic working fluid. As described previously in the context of FIGS. 2A-2C, the power unit 106 may include one or more of the generator 204 and/or the batteries 206. In this regard, the powertrain 101 may be considered a diesel-battery-powered hydraulic-driven powertrain, a battery-powered hydraulic-driven powertrain, a diesel-powered hydraulic-driven powertrain, or the like.

The hydraulic drivetrain 102 may include one or more of an electric motor 302, a hydraulic pump 304, one or more valves 306, one or more hydraulic sub-circuits 308, one or more hydraulic actuators 310, and one or more motor controllers 320. The motor controller 320 may receive electric power from the power unit 106, such as from the generator 204 and/or the batteries 206. The motor controller 320 may then selectively provide the electric power to the electric motor 302. The motor controller 320 may also provide a voltage regulation or a power converter function. The electric motor 302 may then be driven with electric power from the power unit 106. The electric motor 302 may be coupled to the hydraulic pump 304. The electric motor 302 may be coupled to the hydraulic pump by mounting a shaft of the electric motor to the hydraulic pump, by mounting a shaft of the hydraulic pump to the electric motor, and the like. The electric motor 302 may then cause the hydraulic pump 304 to drive a hydraulic fluid with a power, pressure, and/or flow rate. The hydraulic pump 304 may generally include any pump, such as, but not limited to, a piston pump, a vane pump, and the like. The hydraulic pump 304 may pump hydraulic fluid from a hydraulic reservoir 318. The hydraulic fluid may then be routed from the hydraulic pump 304 through one or more hydraulic circuits. For example, the hydraulic fluid may be routed to the valves 306. The hydraulic circuit may include multiple of the valves 306 (e.g., a bank of valves, a hydraulic manifold, etc.) which are each used to split the hydraulic circuit into one or more the hydraulic sub-circuits 308. In this regard, the hydraulic circuit may be considered a main hydraulic line with the hydraulic sub-circuits 308 being secondary hydraulic lines. The hydraulic fluid circulated in the hydraulic sub-circuits 308 may then be provided to one or more hydraulic actuators 310. The hydraulic actuators 310 may receive the hydraulic fluid with a hydraulic power (e.g., based on the hydraulic pressure and hydraulic flow rate) and be actuated according to the hydraulic power. The hydraulic fluid may then be recirculated to the valves 306 and then hydraulic reservoir 318, such that the hydraulic fluid is available to be repumped by the hydraulic pump 304 in the hydraulic circuit.

In embodiments, a rotational speed (e.g., in revolutions per minute (RPM)) of the electric motor 302 may be adaptively controlled. The electric motor 302 may include or otherwise be coupled to the motor controller 320 which performs the adaptive control. For example, the motor controller 320 may receive one or more signals from the machine controller and control the rotational speed accordingly. For example, the rotational speed may be controlled according to one or more methods. Such a method of adaptively controlling the rotational speed of the electric motor 302 may be described further herein in the context of a method for controlling a hydraulic drivetrain with a buffer. The rotational speed of the electric motor 302 may be controlled based on an instantaneous demand of hydraulic fluid. The adaptive control may include calculating a desired rate of flow and controlling the rotational speed of the electric motor 302 to cause the hydraulic pump 304 to generate the desired flow rate. The adaptive control may also include providing a buffer to meet instantaneous increases in the amount of hydraulic power.

In embodiments, the hydraulic drivetrain 102 may include one or more components to reclaim excess hydraulic power of the hydraulic fluid such as the buffer. Reclaiming the excess hydraulic power may improve an efficiency of the system, which would otherwise be lost due to the use of the buffer. The excess hydraulic power may be reclaimed in a number of ways, such as, but not limited to, by cooling one or more components (e.g., the electric motor, motor controller, etc.), a recapture circuit (e.g., an accumulator, to drive a generator, etc.), and the like.

Referring now to FIG. 3B, the powertrain 101 may include the electric drivetrain 104 which is coupled to the power unit 106 for receiving power and driving one or more actuators by electricity. As described previously in the context of FIGS. 2A-2C, the power unit 106 may include the generator 204 and/or the batteries 206. In this regard, the powertrain 101 may be considered a diesel-battery-powered electric-driven powertrain, a battery-powered electric-driven powertrain, a diesel-powered electric-driven powertrain, or the like.

The electric drivetrain 104 may include one or more of a motor controller 312, electric sub-circuit 314, and an electric actuator 316. The motor controller 312 may be configured to receive electric power from the power unit 106. The motor controller 312 may then be configured to control one or more of the electric actuators 316 by way of the electric sub-circuit 314. The motor controller 312 may be coupled to the machine controller (e.g., controller 108).

In embodiments, the motor controller 312 may function as a switchboard, or the like. In this regard, the motor controller 312 may control the amount of power supplied to any number of the electric sub-circuit 314, in a similar manner to the valves of a hydraulic manifold. The motor controller 312 may then be located within the framework and considered some form of a primary motor controller. The electric sub-circuit 314 may then include multiple electrical lines which are split apart at the motor controller 312 and routed to each of the electric actuators 316. Each sub-circuit 314 may also include a secondary motor controller (not depicted), although this is not intended to be limiting. In some instances, the primary motor controller is sufficient such that the secondary motor controller is not used. For example, the motor controller 312 may control a track drive, track steer, lift, pivot arm steer, vibrator, auger, conveyor, trimmer, frame extension, mold shift, bar inserter, finisher, and other sub-circuits of the paving machine 100.

In embodiments, each electric sub-circuit 314 may include a corresponding motor controller 312. Electrical lines from the power unit 106 may be bundled together and split apart for each of the motor controllers 312. The motor controller 312 may be located at the location where the electrical lines are split from the main electrical line. The motor controller 312 may be considered a secondary motor controller which receives control signals (e.g., by a controller area network (CAN) bus) from a primary machine controller (e.g., controller 108) housed within the framework. The motor controller 312 may then control the power supplied to the associated electric actuator 316. It is contemplated that splitting the electrical lines for each of the motor controllers 312 may reduce a number of power lines which need to be shielded within the framework at the expense of additional communication buses between the motor controllers 312 and the controller 108 housed within the framework. For example, each of the track drive, track steer, lift, pivot arm steer, vibrator, auger, conveyor, trimmer, frame extension, mold shift, bar inserter, and finisher sub-circuit may include a separate motor controller which are connected to the controller 108 by one or more CAN buses.

In embodiments, the powertrain 101 and/or the electric drivetrain 104 may include one or more electric lines. The electric lines may be a cable, a busbar, and the like. The electric line may also be made of any conductive material, such as copper or aluminum. The cable and/or the busbar may be housed within one or more cableways or busways. The cableway and/or the busway may be custom fit within one or more components of the paving machine, such as the framework, the pivot arm, or the leg assembly. One challenge with implementing the electric drivetrain 104 is protecting the electrical lines running between the power unit 106, the motor controller 312, the sub-circuit 314, and the electric actuator 316, particularly where the electrical lines carry a high voltage. In this regard, the paving machine may include a number of components which may translate, rotate, or otherwise move. The movement of the components may introduce difficulties in routing the electrical lines without pinching, fraying, or some other failure of the electrical line which may undesirably cause electrification of the frame. In embodiments, the electric lines may be run in one or more conduits. In embodiments, the electric lines may be routed in an accordion wire loom and the like. The accordion wire loom may be designed to be resistant to the environmental conditions associated with paving, such as dust, dirt, and concrete. The accordion wire loom may advantageously allow the electrical line to be routed through telescopic sections of the paving machine 100 while maintaining electrical isolation of the line.

The electric actuators 316 may then receive electrical power from the power unit 106 by way of the motor controller 312 and the electric sub-circuit 314. The electric actuator 316 may include, but not limited to, an electric linear actuator, an electric rotary actuator, an electric motor driven slew drive, and the like. The use of the electric actuator 316 may be advantageous in providing near-instantaneous torque in response to demand changes. The electric motors may be configured for direct drive. The electric motors may also include a gearbox for achieving a desired output force or torque. For example, a gearbox may be provided to achieve a sufficient output torque for track steering. The electric motors may provide a relatively fine resolution in control. For example, the electric motors may include a transducer, such as an encoder, for determine various characteristics (e.g., position, rotational speed in RPM, etc.) of the electric motor.

One challenge with electric actuators is the environment of the paving machine 100. In this regard, the electric actuator 316 may be resistant to dirt, dust, concrete, water, and other environmental conditions. Another challenge with electric actuators is achieving a sufficient duty cycle. Many commercial electric actuators may not meet duty cycle requirements at a given torque or horsepower for the paving machine 100. For example, feedback-controlled steering or elevation changes may cause the electric actuator 316 to be engaged once every few seconds. Existing industrial electric actuators may include a duty cycle which is operated on the order of once per minute. Where the electric actuator 316 includes a sufficient duty cycle, a size of the electric actuators 316 may be overly large, causing a difficulty in fitting the electric actuator in the paving machine 100. In some instances, the electric actuator 316 may be placed on the paving machine 100 to accommodate the form factor. In some instances, a form factor of existing electric actuators which meet the duty cycle and torque requirements may be too large to implement on a paving machine 100. However, the form factor of the electric actuator may be reduced with changes in coil design, gearbox design, and the like, such that the description above is not intended to be limiting.

Another challenge with implementing the electric motor in paving applications is changes in instantaneous loads. For example, the paving machine may run into an obstacle during operation. When subject to the instantaneous loading, the electric motor may stall due to the electric motor reaching a stall torque. If the electric motor is maintained at the stall torque for a given period of time, the electric motor may overheat and fail. In embodiments, the controller 108 and/or the motor controller 312 is configured to detect the electric actuator 316 has been driven for a given amount of time but has not achieved a given amount of actuation (e.g., linear or rotary motion) based on inputs from one or more sensors, indicating the electric actuator 316 is stalled. The machine controller 108 and/or the motor controller 312 may detect the electric actuator 316 is stalled by comparing the amount of actuation with a threshold. In response to detecting the amount of actuation is at or the below threshold, the machine controller 108 and/or the motor controller 312 may then reduce the amount of power supplied to the electric actuator 316 to prevent the electric actuator 316 from overheating.

Referring now to FIG. 3C, the paving machine 100 is described with a hybrid drivetrain including the hydraulic drivetrain 102 and the electric drivetrain 104, in accordance with one or more embodiments of the present disclosure. The paving machine 100 machine may include one or more of the hydraulic sub-circuits 308 and one or more of the electric sub-circuits 314, such that the powertrain 101 may be considered to include both of the hydraulic drivetrain 102 and the electric drivetrain 104 in some form of a hydraulic-electric driven powertrain with any configuration of the power unit 106. In an experimental configuration of a curb-forming machine, the hydraulic drivetrain 102 has included a cylinder, a crawler, a steering sub-circuit, and an auger sub-circuit and the electric drivetrain 104 has included a vibrator sub-circuit. It is further contemplated that the hydraulic drivetrain 102 may be used for one or more linear actuators of the paving machine 100 and the electric drivetrain 104 may be used for one or more rotary actuators of the paving machine 100, although this is not intended to be limiting.

Figure 4:
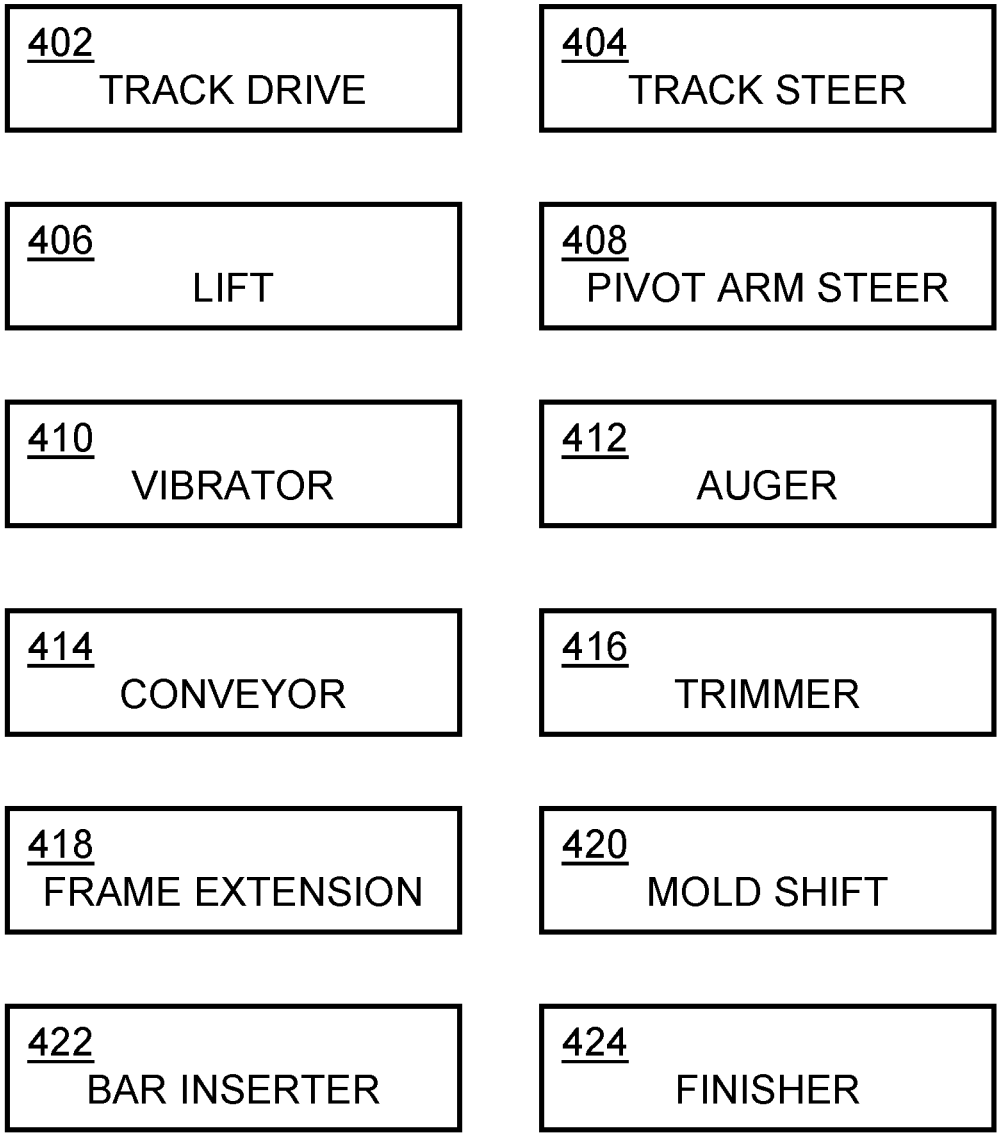
FIG. 4 depicts a simplified block diagram of sub-circuits of a hydraulic drivetrain or an electric drivetrain, in accordance with one or more embodiments of the present disclosure.

Referring now to FIG. 4, sub-circuits of the paving machine 100 are described, in accordance with one or more embodiments. It is contemplated that the sub-circuits described may include the hydraulic sub-circuits 308 and/or the electric sub-circuits 314. As used herein, each sub-circuit may include two lines, a source line and a return line. For example, where the sub-circuit is the hydraulic sub-circuit 308, the source line may be a hydraulic source line from a pump or valve and the return line may be a hydraulic return line to a reservoir. By way of another example, where the sub-circuit is the electric sub-circuit 314, the source line may be a voltage source line and the return line may be a ground.

The paving machine may include one or more sub-circuits which may be based on the configuration of the paving machine 100. The sub-circuits may include, but are not limited to, track drive 402, track steer 404, lift 406, pivot arm steer 408, vibrator 410, auger 412, conveyor 414, trimmer 416, frame extension 418, mold shift 420, dowel bar inserter 422, finisher 424, and the like which may be used in curb forming equipment, slipform pavers (e.g., two-track slipform pavers, three-track slipform pavers, four-track slipform pavers), placing machines, spreading machines, trimming machines, milling machines, texturing machines, finishing machines, and/or bridge deck machines. The track drive 402 may be provided for controlling a forward and reverse motion of a track section of a crawler assembly. The track steer 404 may be provided for adjusting an angle of the crawler assembly. The lift 406 may be provided for controlling a height adjustment (e.g., up and down) of the leg assembly, and similarly for controlling the grade while paving. The pivot arm steer 408 may be provided for adjusting an angle of a pivot arm. The vibrator 410 may be provided for adjusting a frequency of a vibrator. The auger 412 may be provided for adjusting a rotational speed (e.g., in RPM) of an auger. The conveyor 414 may be provided for controlling a drive, a fold, a position, and the like for a conveyor. The trimmer 416 may be provided for controlling a rotational speed (e.g., in RPM) of a trimmer head. The frame extension 418 may be provided for controlling an extension and retraction of an adjustable width frame. The mold shift 420 may be provided for shifting a mold, such as to change a paving width. The dowel bar inserter 422 may be provided for causing a bar inserter to inserter dowel bars within freshly paved concrete. The finisher 424 may be provided for controlling a rotational speed (e.g., in RPM) of an auger and/or a cylinder of a finisher or a screed. It is further contemplated that not all of the above-described machines may include each of the above-described sub-circuits. The above-described machines may further include sub-circuits in addition to the sub-circuits described above.

Each of the sub-circuits described may also be split into any number of additional sub-circuits. For example, a slew drive may include two motors such that the slew drive may be considered a dual-drive slew drive. Each motor of the slew drive may include a separate sub-circuit allowing independent control of each motor, although this is not intended to be limiting. It is further contemplated that the efficiency improvements associated with motors may be sufficiently high such that the dual motors are not independently driven and may instead be run in parallel on the same sub-circuit.

Referring now to an exemplary embodiment of a four-track paving machine. The four-track paving machine may include up to fifty or more of the sub-circuits, totaling one-hundred or more lines (e.g., hydraulic and/or electrical lines). Any number of the sub-circuits may be hydraulic sub-circuits or electric sub-circuits. For example, the four-track paving machine may include four leg assemblies with each leg assembly coupled to a frame by a pivot arm. A crawler assembly may then be coupled below the leg assembly and engaged for propelling the leg assembly and similarly the machine. Each crawler assembly, leg assembly, and associated pivot arm may include four sub-circuits (e.g., track drive 402, track steer 404, lift 406, and pivot arm steer 408), for a total of sixteen sub-circuits. The four-track paving machine may further include up to sixteen, or more, of the vibrator 410 sub-circuits, based on the paving width of the machine. The four-track paving machine may further include between one and four, or more, of the auger 412 sub-circuits. The four-track paving machine may further include one or more sub-circuits, where the four-track paving machine is configured with the conveyor 414, the trimmer 416, the frame extension 418, the mold shift 420, the bar inserter 422, and/or the finisher 424.

The paving machine 100 may generally include any number of permutations of the hydraulic actuators 310 and the electric actuators 316. All possible permutations of the hydraulic actuators 310 and the electric actuator 316 for each sub-circuit of the paving machine 100 are not described herein in the interest of brevity.

It is contemplated that many existing hydraulic rotary actuators of the paving machine 100 may be replaced with electric rotary actuators. It is further contemplated that many existing hydraulic linear actuators may not be replaced. In this regard, hydraulic linear actuators are advantageous over electric linear actuators, given the hydraulic linear actuators maintain position due to the incompressibility of fluid. Instead, the paving machine 100 may be modified to include the electric motor 302 and the hydraulic pump 304 at an intermediary location which may receive electric power from the power unit 106 and supply hydraulic fluid to the hydraulic linear actuator. This may be advantageous for reducing the number of hydraulic lines routed among the paving machine, which may instead be replaced with electric lines. In this regard, a number of the electric motors 302 and the hydraulic pumps 304 may be located outside of the main frame. It is further contemplated that the paving machine 100 may include a main electric motor and hydraulic pump located within the frame with a hydraulic line then routed to the hydraulic linear actuator. Additionally, it is further contemplated that the hydraulic linear actuators may be replaced by the electric linear actuators and/or the hydraulic rotary actuators may not be replaced.

Figure 5:
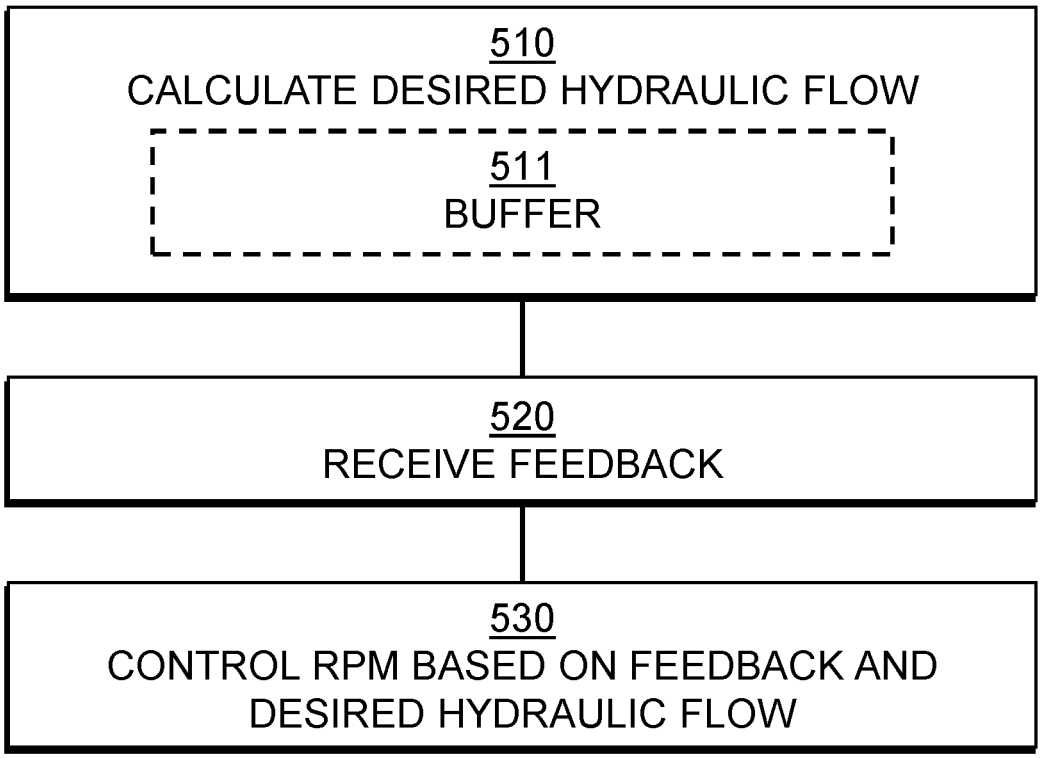
FIG. 5 depicts a flow diagram of a method for controlling a hydraulic drivetrain with a buffer, in accordance with one or more embodiments of the present disclosure.

Referring now to FIG. 5, a method 500 of adaptively controlling a rotational speed (e.g., in RPM) of the electric motor 302 is described, in accordance with one or more embodiments of the present disclosure. The embodiments and the enabling technologies described previously herein in the context of the paving machine 100 should be interpreted to extend to the method 500. For example, the method 500 may be implemented by the controller 108 and/or a motor controller of the electric motor 302. It is further recognized, however, that the method 500 is not limited to the paving machine 100.

In a step 510, a desired hydraulic flow may be calculated. The desired hydraulic flow may be calculated by a controller. The desired hydraulic flow may be based on one or more inputs, such as, a travel speed, an auger speed, a steering angle, trimmer speed, hydraulic fluid power output, hydraulic fluid pressure, hydraulic fluid flow rate, and the like. The controller may then engage the electric motor by providing power from the power unit 106, causing the hydraulic pump to supply the hydraulic fluid.

In some instances, the paving machine may experience rapid changes in demand for the hydraulic flow rate. The rotational speed of the electric motor may be sufficiently high to address immediate demand increases of the hydraulic flow rate. However, the hydraulic pump driven by the electric motor may be unable to provide immediate increases in the hydraulic flow rate, which may be due, in part, to an incompressibility of the hydraulic fluid. In an optional step 511, the desired hydraulic flow may be calculated with a buffer in excess of the actual desired flow rate. The buffer may act as a cushion allowing for accommodating an increase in immediate hydraulic flow rate, up to the limit of the buffer. Increasing the buffer may increase a likelihood there is sufficient flow at a cost of increased power usage. For example, the buffer may be 10% in excess of the actual desired flow rate, although this is not intended to be limiting. In some instances, the buffer may be an average command, such that the electric motor does not continually chase the desired flow rate.

In a step 520, feedback may be received from one or more sensors. The sensors may indicate various data which may be used for feedback control of the electric motor. For example, the sensor data may indicate a spool position of the valves 306, and the like. Each valve of the bank of valves may then be summed to determine the actual hydraulic flow rate. For example, the spool position of each valve may be determined based on the spool position sensor. The feedback of the spool position together with the flow rate through each valve may be used to estimate the flow rate from the pump. A flow requirement estimate is calculated from the valve feedback and then converted to an RPM target for the motor. The RPM target may also include the offset amount or buffer, so that there is more hydraulic fluid being supplied. The buffer hydraulic fluid is then diverted by a valve head section back to a tank which flows through the oil cooler, electric motor, oil filter, and the like. Similarly, hydraulic fluid returning to the valve section may flow along a similar path. The output flow from the hydraulic pump may be estimated based on the RPM of the electric motor and the spool positions, such that there does not need to be a flow meter on the pump. It is further contemplated the pump may include a flow meter.

In a step 530, the rotational speed (e.g., in RPM) of the electric motor may be controlled based on the feedback from one or more sensors. The rotational speed of the electric motor may then be controlled to cause the pump to generate the desired flow rate. If the estimated flow requirements exceed the current flow point the motor speed may be adjusted to match the new requirements. If the estimated flow requirement is less than the current flow point then the motor speed may be slowly reduced until the current flow point matches the estimated flow requirement and/or until a higher target point by a change in the estimated flow. This way the electric motor may spin the hydraulic pump at a rate which should deliver an amount of hydraulic fluid which is close to the required flow point at any moment in time and may also smooth out rapidly changing load requirements. The intent is to cause the motor and pump to deliver hydraulic fluid which is as close as possible to the required flow but not excessively waste energy. As the demand for hydraulic flow rate changes, the rotational speed of the electric motor may be controlled accordingly to provide the desired amount of flow.

Thus, the rotational speed (e.g., in RPM) of the electric motor 302 may be adaptively controlled between a range of rotational speeds based on a desired flow rate of the hydraulic fluid, which may optionally include a buffer. By operating the electric motor 302 at the selected rotational speed, the electric motor 302 may generate a sufficient flow of hydraulic fluid for each of the hydraulic sub-circuits 308 of the paving machine 100. Advantageously, the electric motor may only draw as much current as needed for a given instance in time. In this regard, the ability to adaptively control the power may be beneficial in preserving battery life and/or fuel, thereby increasing an amount of time in which the paving machine 100 may be operated prior to recharge or additional diesel added. The adaptive control may be beneficial across a wide range of paving equipment, regardless of a size of the paving equipment, such as for curb forming equipment, slipform pavers, placing machines, spreading machines, trimming machines, milling machines, texturing machines, finishing machines, bridge deck machines, and the like.

It is further contemplated that the electric drivetrain 104 may control the power output to the electric sub-circuits in a similar manner. However, the electric drivetrain 104 may be able to accommodate for instantaneous changes in demand due to the transmission speed of electricity without using the buffer.

Figure 6A:
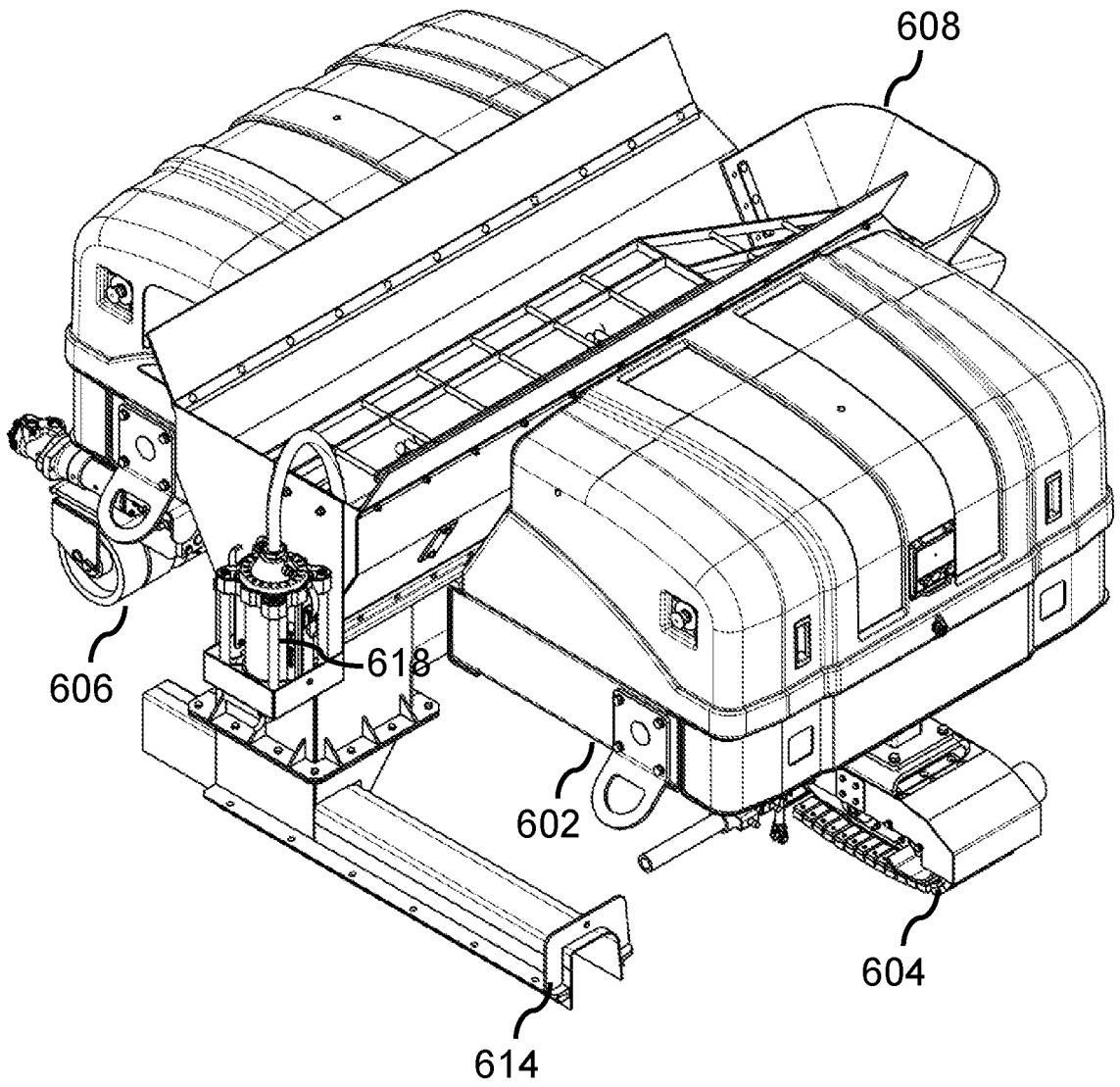
FIG. 6A depicts a perspective view of a curb-forming machine, in accordance with one or more embodiments of the present disclosure.
Figure 6B:
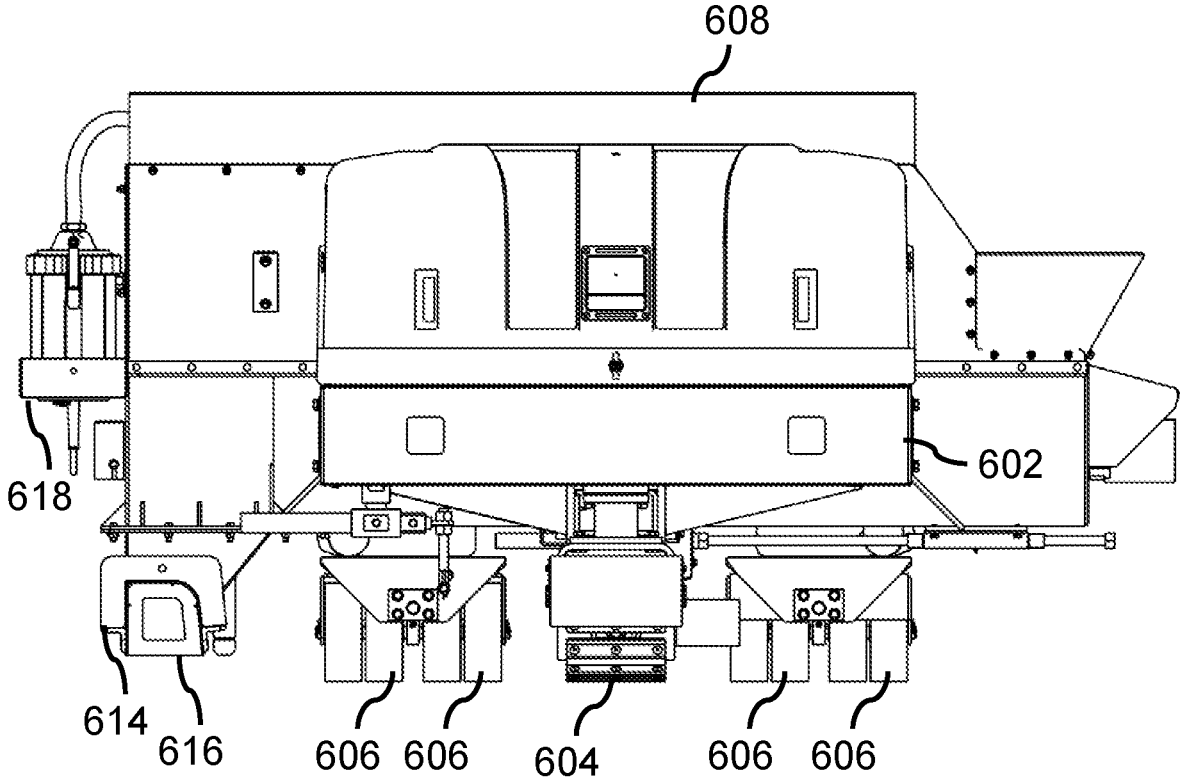
FIG. 6B depicts a rear view of a curb-forming machine, in accordance with one or more embodiments of the present disclosure.
Figure 6C:
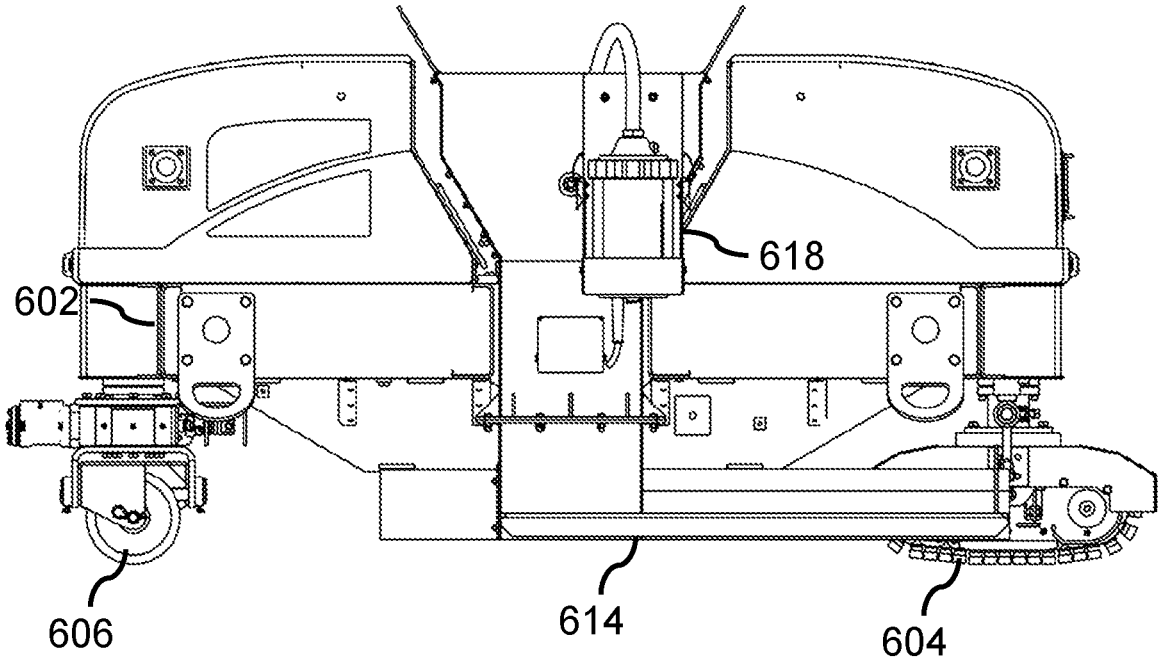
FIG. 6C depicts a side view of a curb-forming machine, in accordance with one or more embodiments of the present disclosure.
Figure 6D:
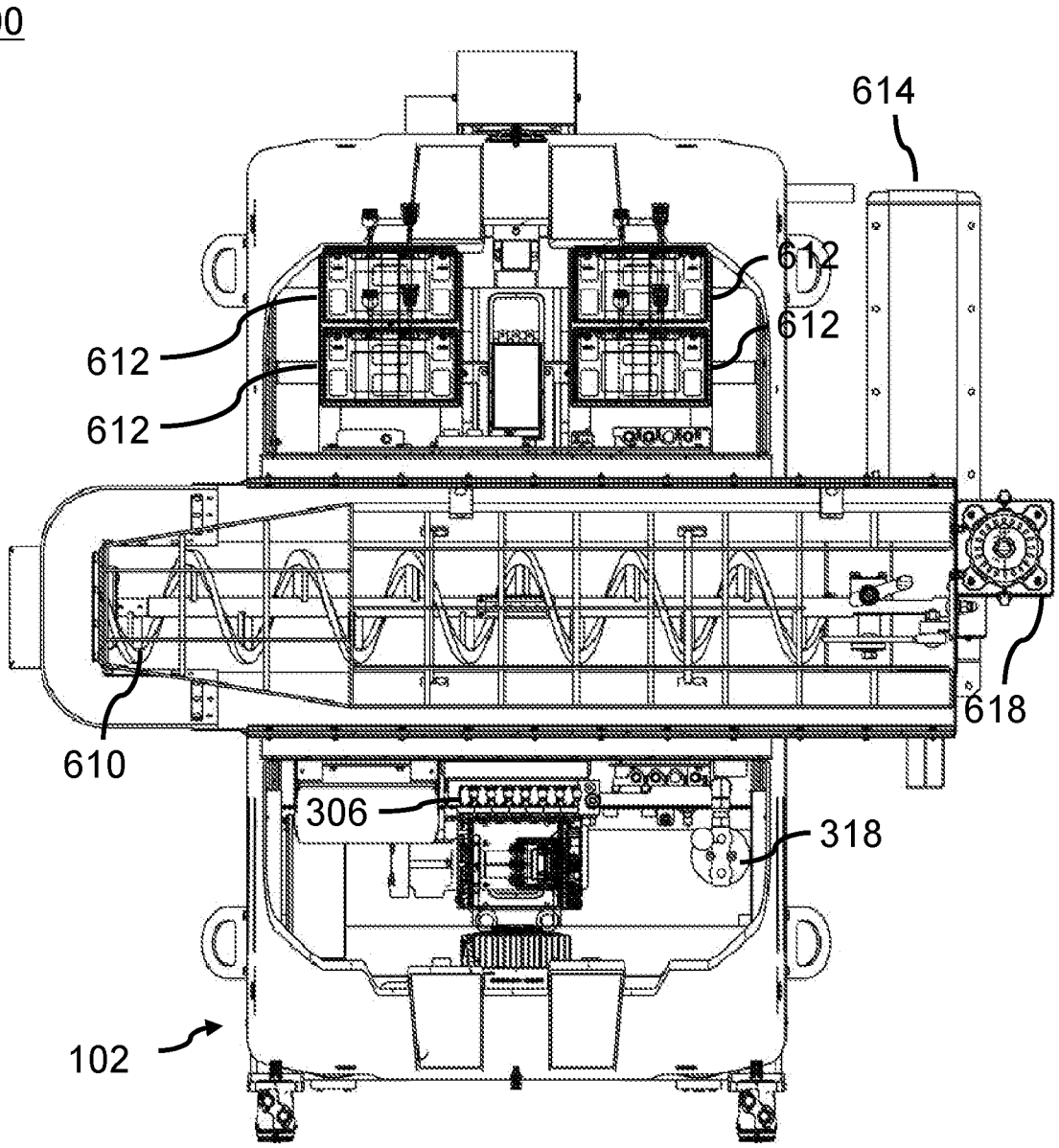
FIG. 6D depicts a top view of a curb-forming machine with one or more cover panels removed to show a power unit including one or more batteries and a hydraulic drivetrain, in accordance with one or more embodiments of the present disclosure.
Figure 7:
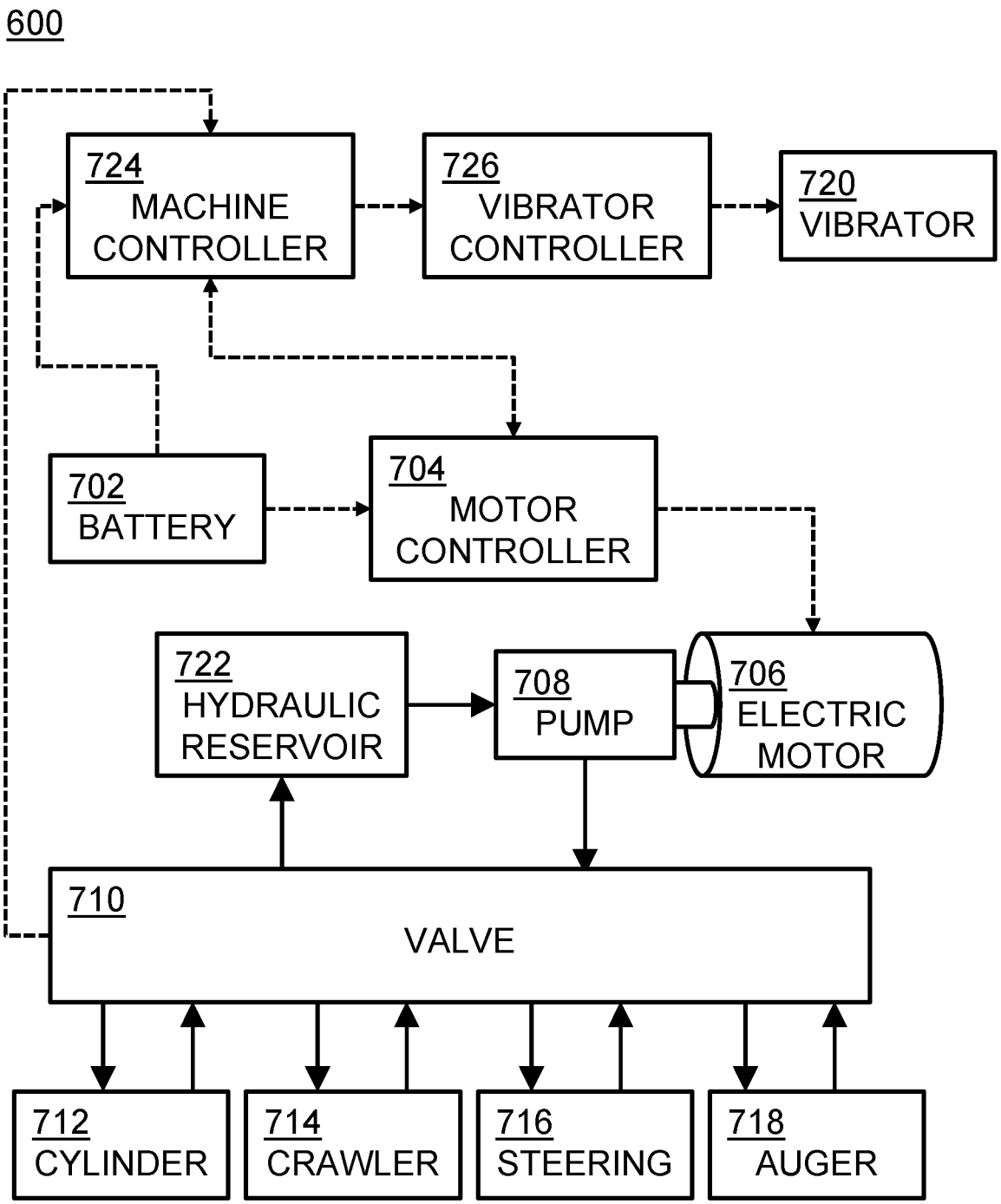
FIG. 7 depicts a simplified electro-mechanical diagram of a curb-forming machine, in accordance with one or more embodiments of the present disclosure.

Referring generally to FIGS. 6A-7, a curb-forming machine 600 is described, in accordance with one or more embodiments of the present disclosure. The embodiments and the enabling technology described herein the context of the paving machine 100 should be interpreted to extend to the curb-forming machine 600.

The curb-forming machine 600 may include a frame 602. The frame may be supported, at least in part, by one or more crawler assemblies 604. The one or more crawler assemblies 604 may propel the curb-forming machine 600 in a direction (e.g., by a hydraulic track drive; by an electric track drive). The frame may also be supported by one or more drive wheels 606. The drive wheels may include one or more rotary actuators (e.g., slew drives) for changing a steering angle of the curb-forming machine 600. One or more of the crawler assemblies 604 or the drive wheels 606 may be coupled to the frame by a hydraulic cylinder. The hydraulic cylinder may be configured with a stroke (e.g., ten inches) for adjusting a height of the frame 602 relative to a ground surface. The curb-forming machine 600 may also include a hopper 608 coupled to the frame 602. The hopper 608 may be configured to receive a material. An auger 610 may be configured to convey the material from the hopper 608 in a direction transverse to the direction of travel. The auger 610 may convey such material to a mold 614. The mold may include a profile for forming the material into a curb shape as the curb-forming machine 600 travels in the direction. Such mold may include any suitable profile for forming the material into a curb shape 616, such as, but not limited to, straight curbs, mower curbs, or slanted curbs. Such mold 614 may similarly include a range of working widths, such as, but not limited to a width between zero and twelve inches and a height between zero and fourteen inches. Furthermore, the mold 614 may be configured to form the material into a curb and gutter simultaneously. As may be understood, the discussion of the mold 614 forming the material into the cub shape 616 is not intended to be limiting for the paving machine 100 and is merely recited as one example of a mold used for the curb-forming machine 600. Where the paving machine 100 includes a mold, the mold may generally include any suitable profile based on the relevant configuration of the machine for forming the material into a shape, such as a roadway mold, a barrier mold, a curb mold, a sidewalk mold, and various other molds known in the art. In embodiments, the curb-forming machine 600 may include one or more vibrators 618. The vibrators may provide eccentric motion to the mold 614 and/or material within the mold, for consolidating the material into the curb shape 616. The vibrator 618 may include any electric vibrator, such as, but not limited to, a Stinger 15-amp 115-volt universal motor, core, and vibrator assembly. The vibrator 618 may further include a flexible shaft inserted into a top opening of the mold 614 for vibrating the mold and/or the material within the mold.

In embodiments, the curb-forming machine 600 may include one or more batteries 612. The batteries 612 may store and produce an electric power. The batteries 612 may include any battery known to store and produce electric power. For example, the batteries 612 may include, but are not limited to, a lithium-ion battery, a lead-acid battery, or the like. Furthermore, the batteries 612 may include, but are not limited to, a size 27 lithium-ion battery. In some embodiments, one or more of the batteries are combined in series to increase a voltage and/or in parallel to increase an amp-hour capacity (e.g., a battery pack). In this regard, the batteries 612 may include any suitable voltage, such as, but not limited to, 12 volts, 24 volts, 36 volts, 48 volts, 72 volts, some voltage thereof, or a greater voltage. The batteries 612 may also include or be coupled to a battery management system. Such batteries 612 may provide electric power to one or more components of the curb-forming machine 600, as described further herein. The batteries 612 may be one or more of rechargeable or replaceable. For example, the batteries 612 may be recharged by one or more direct current battery chargers known in the art. Although the batteries 612 are described as being recharged by a battery charger, this is not intended as a limitation of the present disclosure.

Referring now to FIG. 7, an electro-mechanical block diagram of the curb-forming machine 600 is described, in accordance with one or more embodiments. In embodiments, the curb-forming machine 600 may be configured for electric-to-hydraulic paving by including the power unit 106 and the hydraulic drivetrain 102. In this regard, the curb-forming machine 600 may include one or more of a battery 702, a motor controller 704, an electric motor 706, a pump 708, and a valve 710.

The curb-forming machine 600 may include one or more the batteries 702 (e.g., battery 612). The batteries 702 may store and produce an electric power. The curb-forming machine 600 may also include one or more motor controllers 704. The motor controller 704 may receive electric power from the batteries 702. The motor controller 704 may then selectively provide the electric power to one or more additional components. For example, the motor controller 704 may provide such electric power to an electric motor 706. The motor controller 704 may also provide a voltage regulation or a power converter function.

The curb-forming machine 600 may include one or more electric motors 706. In response to the electric power, the electric motor 706 may engage one or more hydraulic pumps 708. The electric motor 706 may operate with a given rotational speed (e.g., in RPM) for generating the flow. The rotational speed may include a range of suitable values, such as, but not limited to, between 600 RPM and 2000 RPM. The electric motor 706 may include any suitable electric motor, such as, but not limited to, a Parker electric motor.

The curb-forming machine 600 may include one or more hydraulic pumps 708. The pump may include any pump, such as, but not limited to, a vane pump. The hydraulic pumps 708 may be driven by the electric motor 706, thereby generating a hydraulic flow. Such hydraulic flow may then be provided to one or more components of the curb-forming machine 600, such as, but not limited to, a hydraulic cylinder 712, a crawler assembly 714 (e.g., a track drive of the crawler assembly 604), a steering assembly 716, an auger 718, or a vibrator 720. In some embodiments, the hydraulic flow follows a loop through the pump 708, the valve 710, the one or more components, and a hydraulic reservoir 722.

The curb-forming machine 600 may include one or more valves 710. The valves 710 may connect the hydraulic pump 708 with the one or more components. The valves 710 may include any suitable valve, such as, but not limited to, an eight-section valve. As may be understood, the number of sections is not intended to be limiting. In this regard, a number of valve sections may be based, at least in part on a number of components powered by the hydraulic flow. For example, the curb-forming machine 600 may include three hydraulic cylinders 712, one track drive for the crawler assembly 714, two steering assemblies 716, and one auger 718. It is contemplated that the valves 710 may include fewer or additional sections where the curb-forming machine 600 includes additional hydraulic components, such as, but not limited to, independently controlled crawler tracks.

Although the vibrator 720 is described as receiving a hydraulic flow from the valve 710, this is not intended as a limitation of the present disclosure. In this regard, the vibrator 720 may include an electric vibrator (e.g., the vibrator 618). The electric vibrator may receive electric power (e.g., from the battery 702). In response to the electric power, the electric vibrator may generate an eccentric movement for consolidating a material (e.g., a concrete material). A speed of the vibrator 720 may be controlled by a vibrator controller 726.

A machine controller 724 may relay commands to and from the motor controller 704 and/or the vibrator controller 726. The machine controller 724 may include any machine controller, such as, but not limited to, a 24 pin Danfoss controller (e.g., a DM430 Series). The machine controller 724 may also control the vibrator 720 speed with an analog signal to a vibrator controller 726. Such machine controller 724 may further receive signals (not depicted) from one or more components, such as, but not limited to, the hydraulic cylinder 712, the crawler assembly 714, the steering assembly 716, or the auger 718. In this regard, one or more of the hydraulic cylinder 712, the crawler assembly 714, the steering assembly 716, or the auger 718 may include an encoder or sensor for detecting an associated position.

In embodiments, the electric motor 706 may be driven at a maximum rotational speed. However, such maximum rotational speed may generate excess hydraulic flow. In embodiments, the motor controller 704 adaptively controls the electric motor 706 based on a demand. The valve 710 may provide percentage feedback for spool position based on a measured hydraulic flow. The percentage feedback may be provided to one or more controllers, such as, but not limited to, the motor controller 704 or the machine controller 724. For example, the percentage feedback may be provided from the valve to the machine controller 724 and subsequently the motor controller 704, for calculating the rotational speed commands for the electric motor 706. Given the properties of the valve 710, a flow characteristic may be determined based on the requested drive. Power supplied to the electric motor 706 may be increased to provide the requested flow. In this regard, the motor controller 704 may selectively control the electric motor 706 based on a signal received by the valve 710. Thus, the motor controller 704 may control the rotational speed of the electric motor 706 with such rotational speed proportionally corresponding to an amount of hydraulic flow. Electric power may be conserved by operating the electric motor 706 at less than a maximum rotational speed.

In embodiments, the amount of power supplied to the electric motor 706 may be increased above the current demand (e.g., a 10 percent offset) so if there is a discrepancy in feedback there may be sufficient hydraulic power generated. The valve 710 may include a section which circulates flow back to the hydraulic reservoir 722. In some embodiments, excess flow may be used to improve an energy efficiency. For example, the excess flow may be run through a cooler to cool the electric motor 706.

In embodiments, the motor controller 704 may be isolated on a separate controller area network (CAN). In this regard, the motor controller 704 may include a separate CAN for isolating the signals to the electric motor 706. The CAN network between the motor controller 704 and the machine controller 724 may become unstable when attempting to turn the electric motor 706 due to voltage spikes. By isolating, the motor controller 704 signals may be transmitted without disruption to other components of the machine, such as the vibrator controller 726.

An operation of the curb-forming machine 600 is now described. The motor controller 704 may use a voltage (e.g., 48V) to control the speed of the electric motor 706. The electric vibrator has a power converter to increase the voltage (e.g., to 96V-120V). A downconverter (e.g., 48V to 24V converter) may provide power to various other components. A main power disconnect switch may allow for a completed circuit when enabled. When the disconnect is enabled a Power Distribution module may be active and provides power to the machine key switch. The remaining components are not powered until the key switch is turned to an Ignition or Accessory switch state. The Start position may be used to force the user to place the machine in operating condition. The machine will not have hydraulic power until it has been "Started." A fault may be triggered when the user attempts to operate the machine and the machine has not been "Started".

The motor 706 may not spin until the curb-forming machine 600 has been "started." A user may start the curb-forming machine 600 by putting the machine in an operable state. A horn may then sound to acknowledge when the condition has been met. Once the curb-forming machine 600 has been started there may be a minimum rotational speed command established from hydraulic pump requirements to achieve flow. Then, using spool demand feedback from the CAN valve, an rotational speed command may be established to achieve the required flow rate. This flow rate estimate may be increased by an amount (e.g., 10%) to ensure there is enough flow. If the current demand is less than current rotational speed of the motor, the rotational speed command may be slowly reduced to increase efficiency in the system. Extra flow may be returned to a hydraulic tank by the CAN valve inlet section.

When the curb-forming machine 600 is put into standby mode (also referred to herein as an idle mode) a timer may be started to track how long the machine has been idle. In some instances, the motor may include a stored value for a minimum rotational speed command at which the pump may function, such as, but not limited to, 600 RPM. The electric motor may be set to the minimum rotational speed command when put into standby mode. The electric motor may be set at the stored value for a duration after being put into standby mode. After the paving machine is idle for a time (e.g., 2 minutes) then the rotational speed command for the motor may be nulled or otherwise set to zero. By setting the rotational speed command to zero, the hydraulic fluid may be prevented from being pumped to save power. The motor may then resume when the machine is returned to Run mode. Providing the idle before nulling the rotational speed command may be advantageous in providing a time in which the user may briefly pause operations, idle the machine, and resume without noticeable drops in machine performance.

The curb-forming machine 600 has been experimentally determined to include a paving duration of between 6 and 6.5 hours, although this is not intended to be limiting. Advances in power density of the battery may improve the paving duration. In some instances, a weight of the curb-forming machine 600 may be around 4,500 pounds, which may be heavier than conventional diesel curb formers, such as a Gomaco Curb-Cadet 1200 which includes a weight of around 3,500 pounds. As may be understood, the weight and paving duration described is not intended to be limiting. The weight and paving duration of the curb-forming machine 600 may be improved with improvements in power density of the batteries.

In some embodiments, the curb-forming machine 600 may include one or more displays (not depicted). The displays may include any display, such as, but not limited to, a DM430 Series Display. In some instances, the display may function as the machine controller 724, although this is not intended to be limiting. In other instances, the display may be coupled to the machine controller 724 and be considered a passive display. In some embodiments, the curb-forming machine 600 may include one or more remote controls (not depicted). The remote control may be used to provide a user with a remote machine function interaction.

Although the curb-forming machine 600 has been described as including one or more components of a hydraulic drivetrain, this is not intended to be a limitation of the present disclosure. In embodiments, the curb-forming machine 600 may be considered a fully electric vehicle. Such fully electric paver may include appropriate circuits, electric auger, electric lift actuator, and electric steer actuators for providing curb-forming functionality. In this regard, the electric actuator components may include a duty cycle which is sufficient to handle paving operations without overheating and which may be engaged in an automatic fashion by one or more controllers. Furthermore, providing electric direct drive may be advantageous in improving energy efficiency, due to energy losses associated with conversion to hydraulic power or transfer of hydraulic power via one or more lines.

Figure 8A:
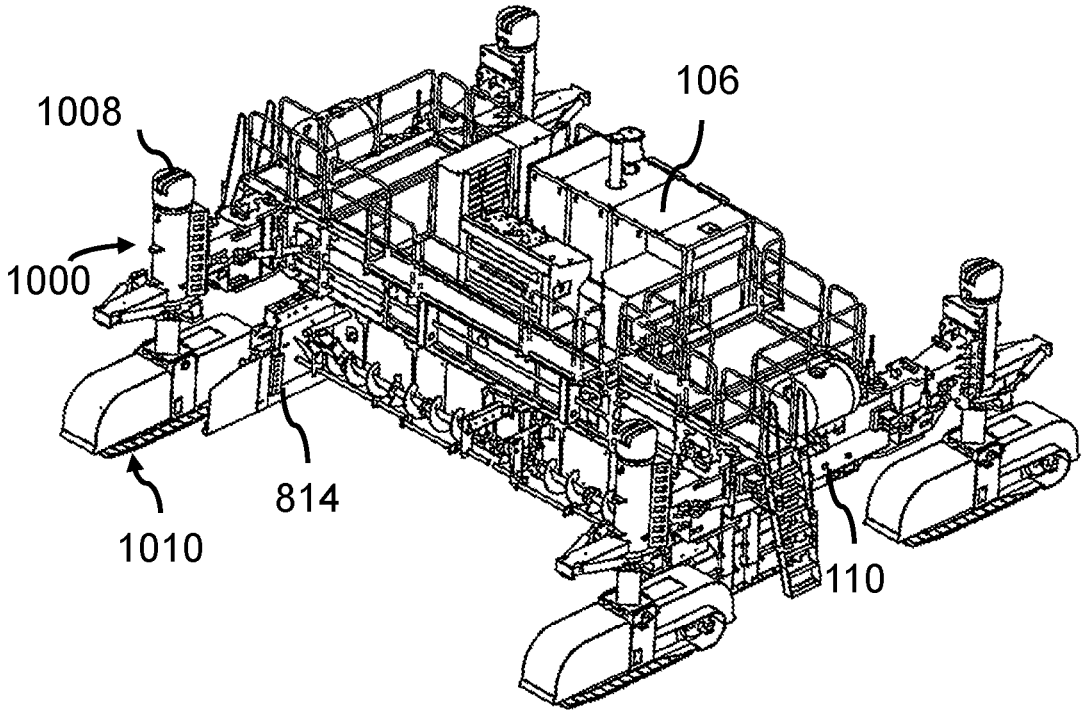
FIG. 8A depicts a perspective view of a four-track paver, in accordance with one or more embodiments of the present disclosure.
Figure 8B:
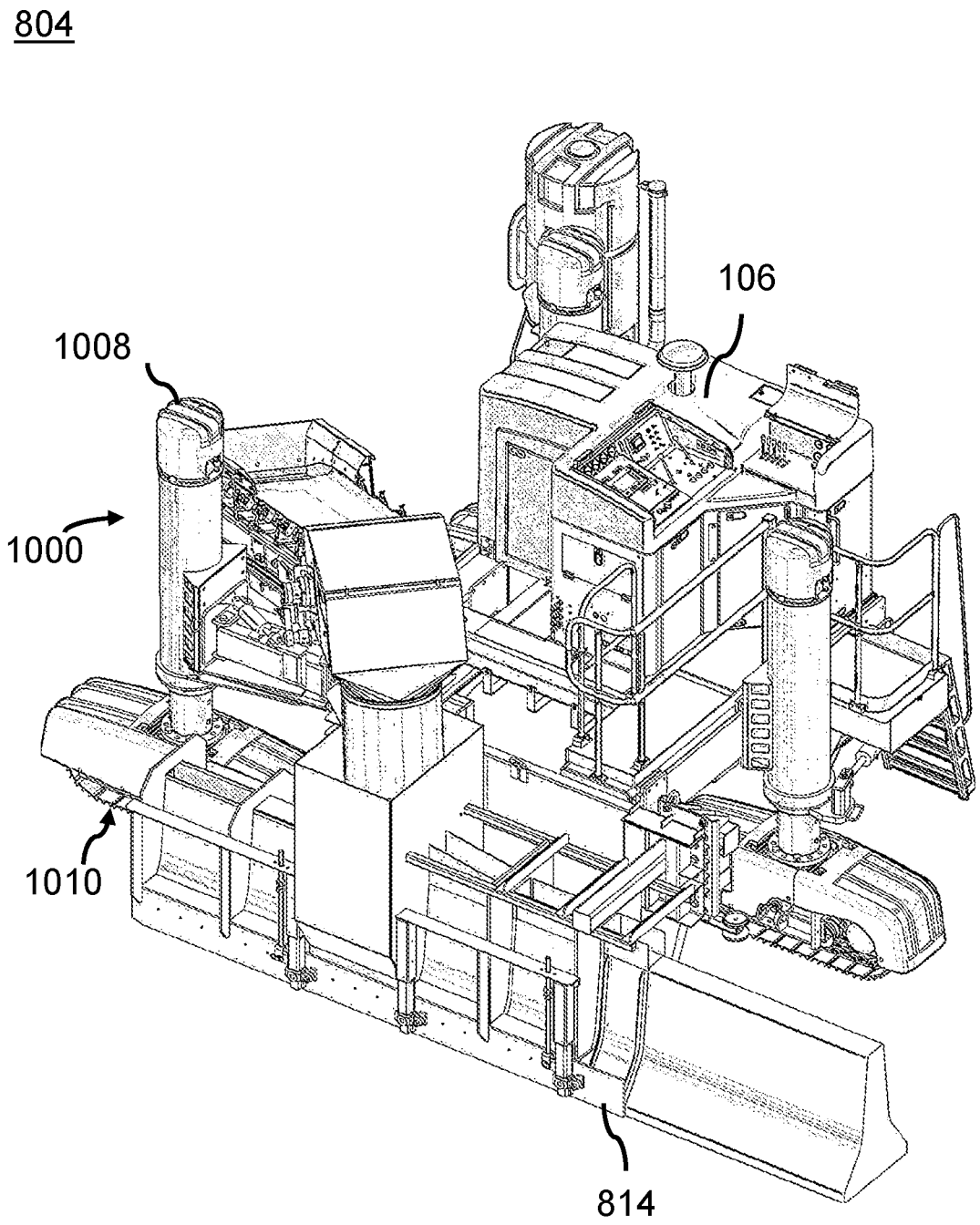
FIG. 8B depicts a perspective view of a three-track paver, in accordance with one or more embodiments of the present disclosure.
Figure 8C:
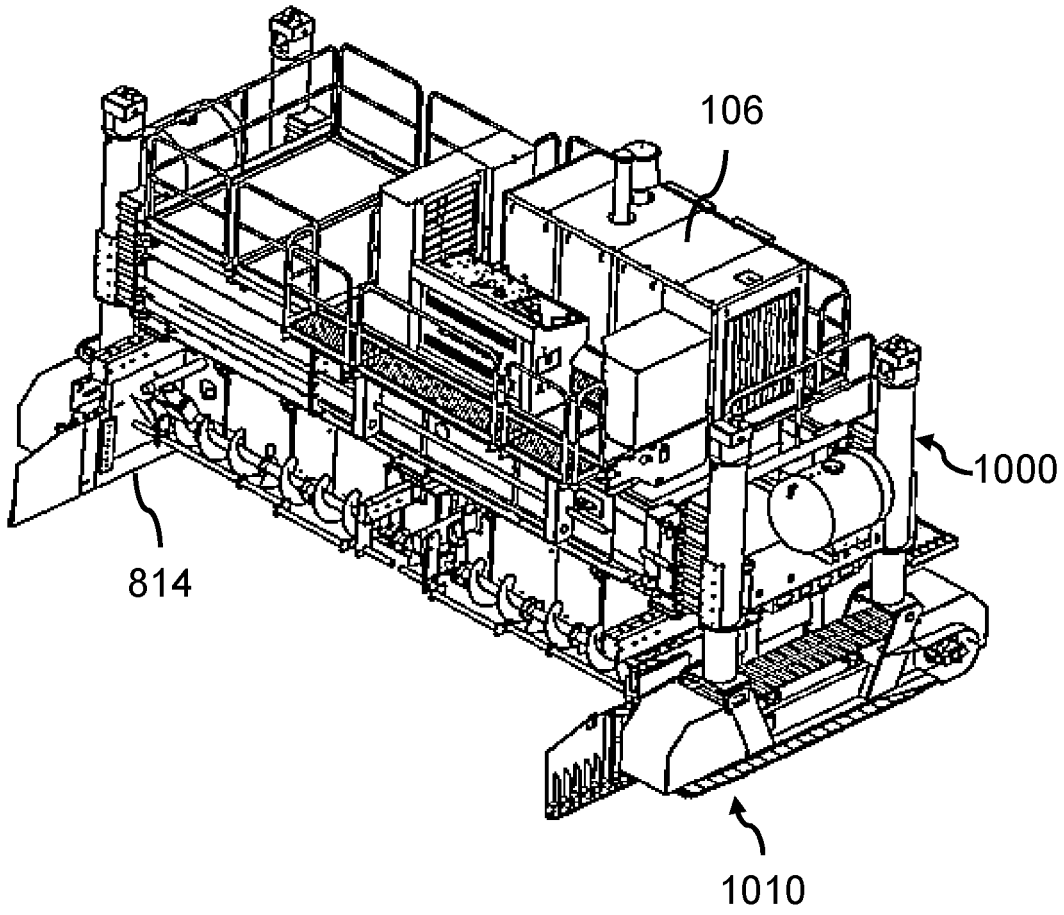
FIG. 8C depicts a perspective view of a two-track paver, in accordance with one or more embodiments of the present disclosure.
Figure 8D:
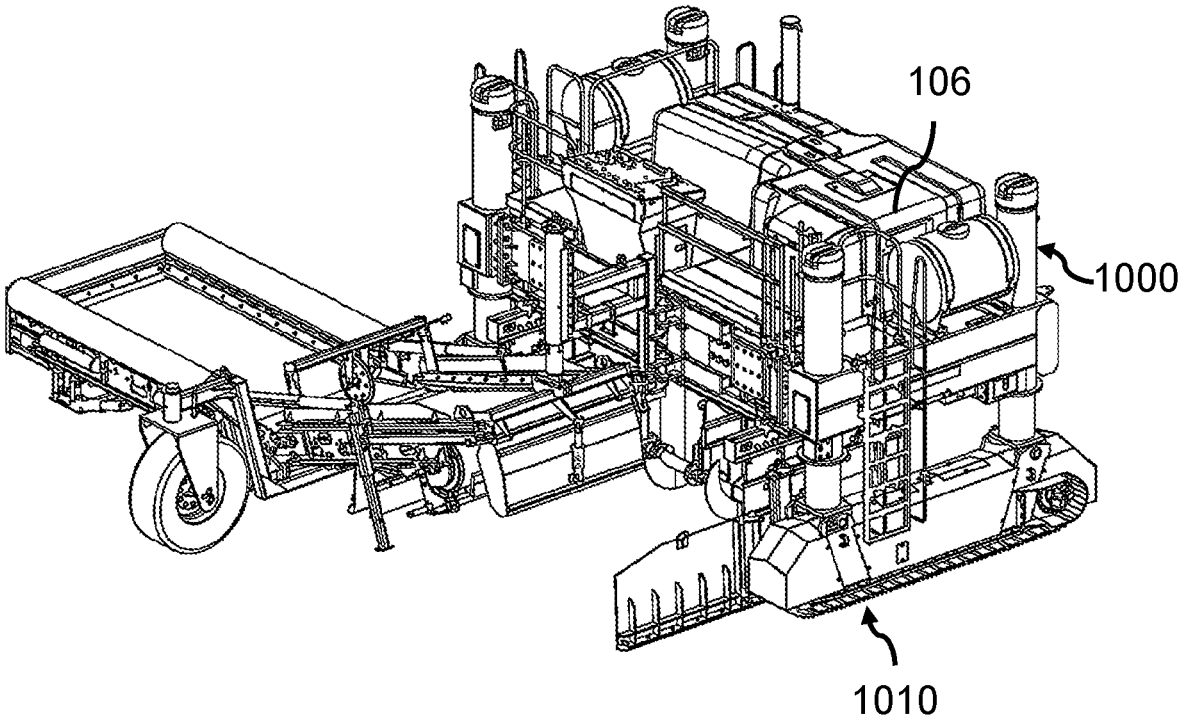
FIG. 8D depicts a perspective view of a two-track placer spreader machine with a conveyor to place material in front of the machine, in accordance with one or more embodiments of the present disclosure.
Figure 8E:
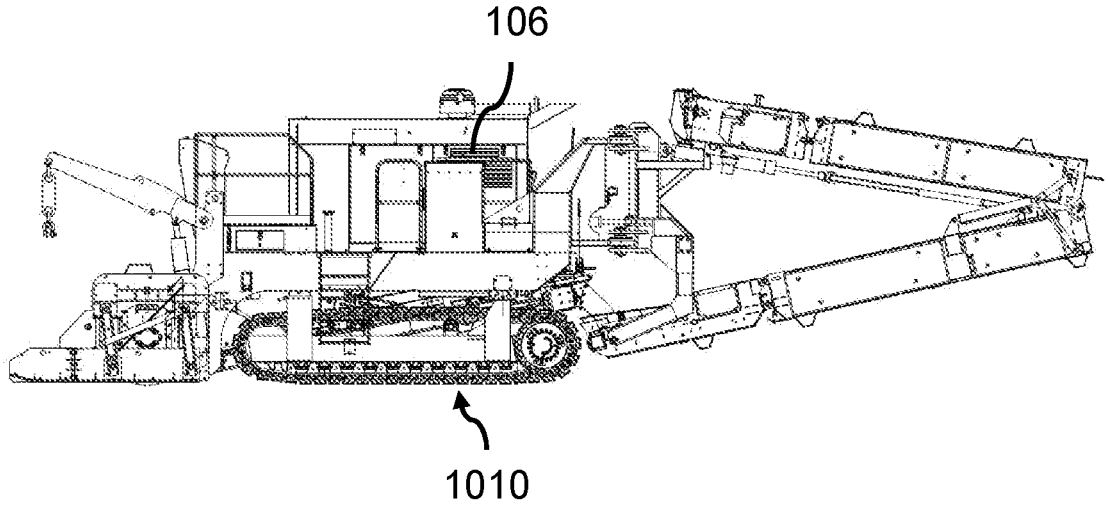
FIG. 8E depicts a side view of a trimmer placer machine, in accordance with one or more embodiments of the present disclosure.
Figure 8F:
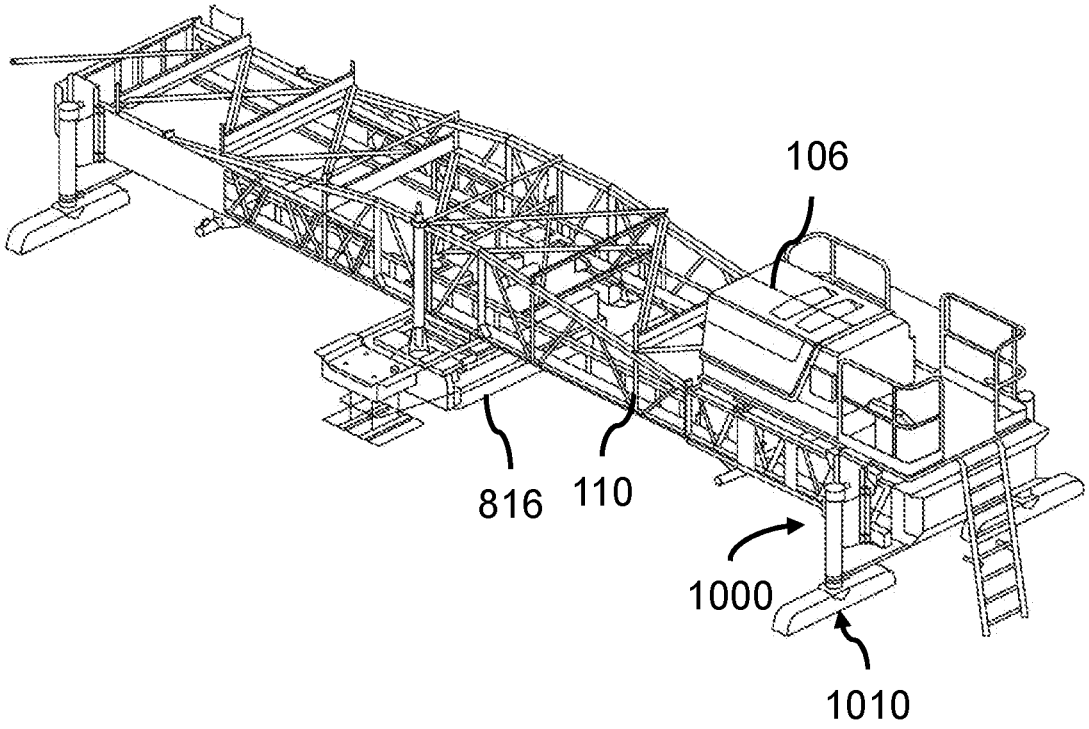
FIG. 8F depicts a perspective view of a bridge deck paver including a cylinder finisher, in accordance with one or more embodiments of the present disclosure.

Referring generally to FIGS. 8A-8F, one or more examples of the paving machine 100 are described, in accordance with the present disclosure. Although the present disclosure has described the paving machine 100 as including the curb-forming machine 600, this is not intended as a limitation on the present disclosure. In this regard, aspects of the present disclosure may be applied to any configuration of paving machines. As depicted in FIG. 8A, the paving machine 100 may be a four-track slipform paver 802. As depicted in FIG. 8B, the paving machine 100 may be a three-track slipform paver 804. As depicted in FIG. 8C, the paving machine 100 may be a two-track slipform paver 806. As depicted in FIG. 8D, the paving machine 100 may be a two-track placer spreader machine with a conveyor to place material in front of the machine. As depicted in FIG. 8E, the paving machine 100 may be a trimmer placer machine 810. As depicted in FIG. 8F, the paving machine 100 may be a bridge deck machine 812 including a cylinder finisher.

Any of the four-track slipform paver 802, the three-track slipform paver 804, the two-track slipform paver 806, the placer spreader machine 808, the trimmer placer machine 810, or the bridge deck machine 812 may include the various features described. For example, the machines may include the powertrain 101 with the power unit 106 (e.g., including the generator 204 and/or the battery 206) and with the drivetrain (e.g., the hydraulic drivetrain 102, and/or the electric drivetrain 104). Thus, the various paving machines depicted may be adapted for the various powertrains described herein to achieve any of the advantages described herein, such as compliance with a given regulatory standard, efficiency improvements, and/or to reduce emissions.

As may be understood, the power unit 106 and drivetrain may be adapted according to a need of the associated paving machine. As a size of the machine increases, the power unit may generally require additional power to meet paving needs. Additionally, some paving applications may require additional power due to performing milling or trimming operations. It is contemplated that the power unit 106 may be adapted to output a wide range of powers, such as, but not limited to, between 24 and 400 horsepower, or more. The power unit 106 may also be adapted with a sufficient capacity to meet a desired number of paving hours.

In embodiments, the paving machine includes a mold 814 for slip forming a material into a shape. Although the present disclosure has described the paving machine 100 as including the mold 814 for slip forming a material into a shape, this is not intended to be limiting. The paving machine 100 may not include the mold 814 depending upon the configuration and the function of the paving machine 100. For example, the bridge deck machine 812 may include a cylinder finisher 816 attachment for forming material into a bridge deck surface. By way of another example, the trimmer placer machine 810 may not be configured to form material into shape.

Figure 9:
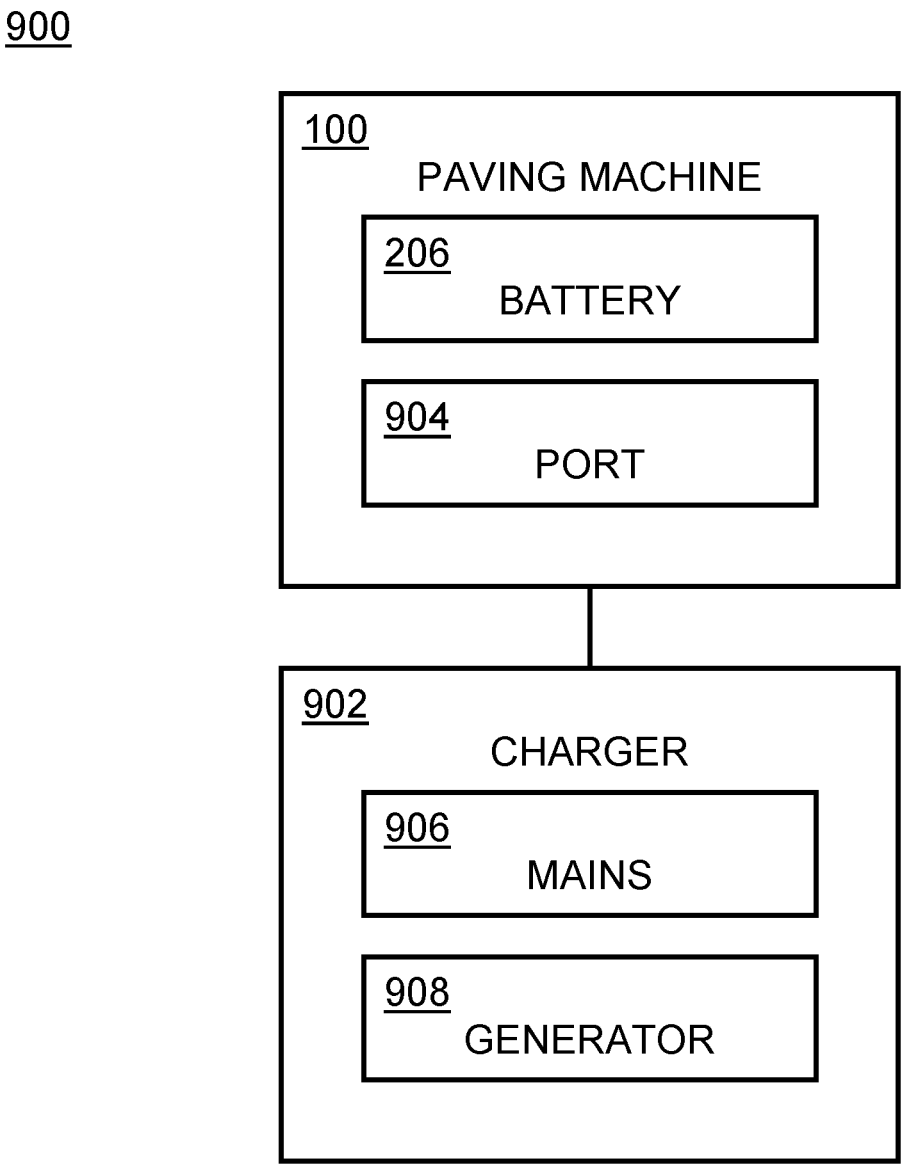
FIG. 9 depicts a simplified block diagram of system for charging a battery of a paving machine, in accordance with one or more embodiments of the present disclosure.

Referring now to FIG. 9, a system 900 for charging the battery 206 is now described, in accordance with one or more embodiments of the present disclosure. In embodiments, the battery 206 may be rechargeable. The battery 206 may be recharged using a battery charging system 902 and a charge port 904. The charge port 904 may be located in one or more locations of the paving machine 100. The battery charging system 902 may be coupled to the charge port 904. The battery 206 may then be configured to receive electric power from the battery charging system 902 by way of the charge port 904.

The battery charging system 902 may operate using single-phase power, such as, but not limited to, 120-volt single-phase, 240-volt single-phase, and the like. Alternatively, the battery charging system 902 may operate with three-phase power, such as, but not limited to, 208-volt three-phase, 240-volt three-phase, 320-volt three-phase 480-volt three-phase, and the like. The battery charging system 902 may be considered a rapid charge system or an overnight charge system. In some instances, the battery 206 may be charged with a given amperage, such as, but not limited to 15 to 20 amps DC, based on a requirement of the battery charging system 902.

One problem associated with the use of the battery 206 in the paving machine 100 is recharging the battery 206. In this regard, the paving machine 100 is commonly operated in an environment without access to main power from the electric grid (e.g., an off-highway environment). In some instances, the battery charging system 902 includes a mains power 906, such that the paving machine 100 may be hauled to a facility which includes the mains power 906 for charging the battery 206. In some instances, the battery charging system 902 includes a diesel generator 908. The diesel generator 908 may be connected to a pull-behind trailer, a stationary generator station, or the like.

The battery charging system 902 may also configured to winterize the battery by trickle charging the battery.

Figure 10:
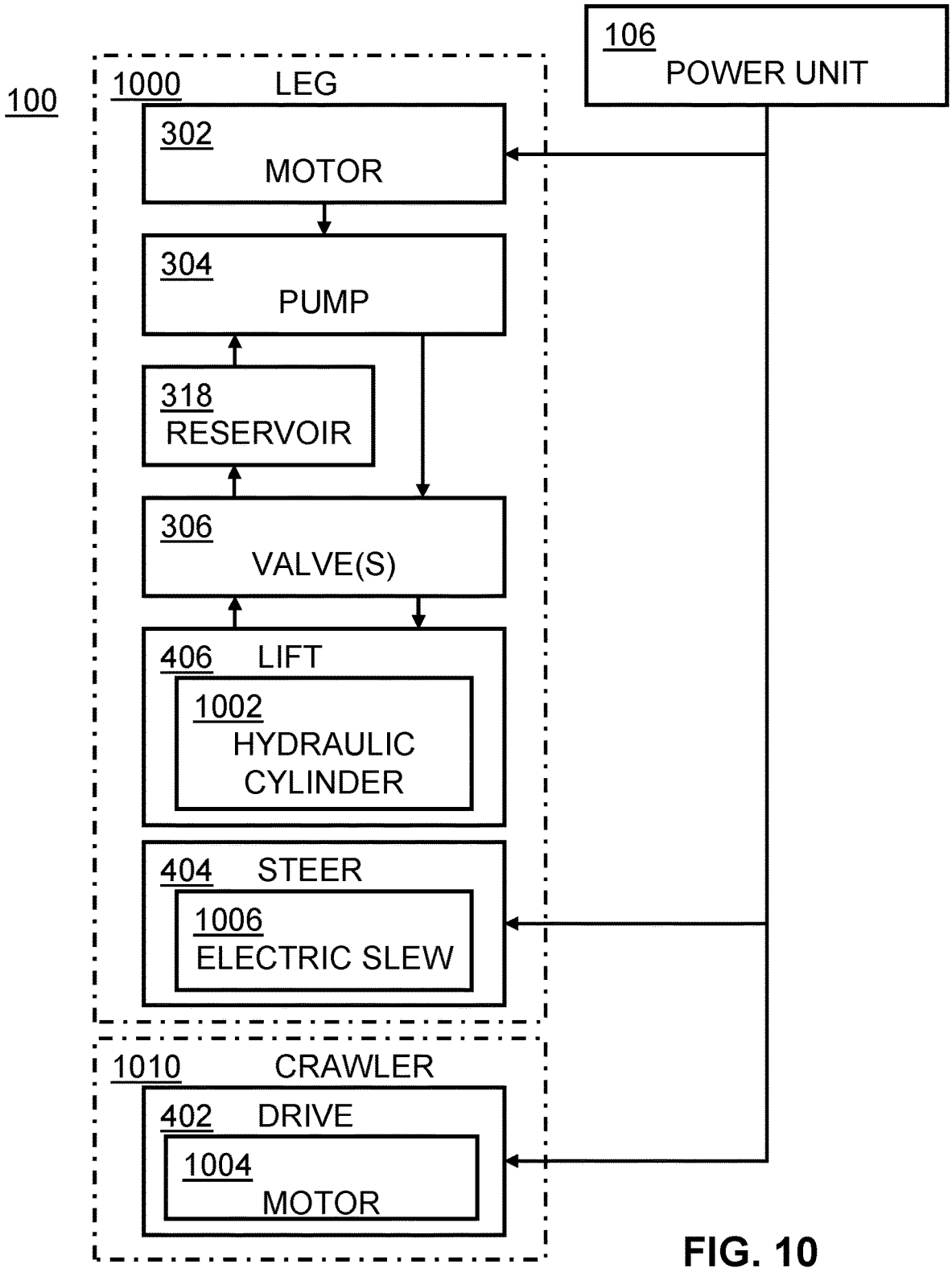
FIG. 10 depicts a simplified block diagram of a paving machine including a leg assembly and a crawler assembly, in accordance with one or more embodiments of the present disclosure.

Referring now to FIG. 10, an exemplary drivetrain of the paving machine 100 is described, in accordance with one or more embodiments of the present disclosure. The paving machine 100 may include two, three, or four of the leg assemblies 1000 with an associated steering sub-circuit 404 and crawler assembly 1010 disposed below the leg assembly 1000. The leg assembly 1000 may include one or more components of the hydraulic drivetrain 102 and one or more components of the electric drivetrain 104, such that the paving machine 100 is equipped with some form of a hydraulic-electric powertrain. The leg assembly 1000 may include one or more of the electric motor 302, the hydraulic pump 304, the valve 306, the hydraulic sub-circuits 308, and/or the hydraulic actuators 310. Similarly, the leg assembly 1000 may include one or more of the motor controller 312, the electric-sub-circuit 314, and/or the electric actuator 316.

For example, the leg assembly 1000 may include a hydraulic cylinder 1002 disposed within one or more tubes of the leg assembly 1000. The hydraulic cylinder 1002 may form part of the lift 406 sub-circuit. The leg assembly 1000 may additionally include the electric motor 302 and the hydraulic pump 304. In some instances, the electric motor 302 and the hydraulic pump 304 may be mounted above the hydraulic cylinder 1002 and may be covered by a molded end-cap 1008 of the leg assembly. The electric motor 302 may receive electric power from the power unit 106 disposed within the main frame which is routed to the electric motor 302 by an electrical line. The electric motor 302 may be controlled by the motor controller 312, which may be coupled to the leg assembly 1000, the pivot arm 106 the frame 102, and the like. The electric motor 302 may then drive the hydraulic pump 304 causing the pump to route hydraulic fluid to the hydraulic cylinder 1002 within the leg assembly. By receiving the hydraulic fluid, the hydraulic cylinder 1002 may be used to extend and retract the crawler assembly for adjusting a height of the leg assembly 1000 and similarly the paving machine 100. This circuit may be advantageous in that the pump of the leg assembly 1000 does not need to be run to maintain the current height of the leg assembly 1000 until a height adjustment change is made. The use of the hydraulic cylinder 1002 may also be advantageous in maintaining a reduced form factor for the leg assemblies, while maintaining height adjustment functionality when using an electric power unit.

By way of another example, the leg assembly 1000 may include an electric slew drive 1006. For instance, the electric slew drive 1006 may be coupled at a bottom end of the leg assembly 1000 or between the inner and outer tubes of the leg assembly 1000. The electric slew drive 1006 may form part of the track steer 404 sub-circuit. The electric slew drive 1006 may include one, two (e.g., a dual drive), or more electric motors which receive electric power from the power unit 106 disposed within the main frame which is routed to the electric linear actuator by an electrical line. In this regard, the leg assembly 1000 may include one or more electric slew drives which are used to steer the tracks. The electric slew drive 1006 may be controlled by the motor controller 312 which may be coupled to the leg assembly 1000, the pivot arm 106 the frame 102, and the like. An angular position of the crawler assembly 1010 may then be controlled with a high level of precision. Although the leg assembly 1000 is described as including the electric slew drive 1006, this is not intended as a limitation of the present disclosure. For example, the leg assembly 1000 may include a hydraulic cylinder for steering, as is known. By way of another example, the leg assembly 1000 may include two columns as depicted in FIG. 8C (i.e., for the two-track paver 806 where each leg assembly includes two columns), such that steering is instead performed by skid-steering.

By way of another example, the paving machine 100 may include the crawler assembly 1010 coupled below the leg assembly 1000. The crawler assembly 1010 may include a may include an electric motor 1004 disposed within the crawler assembly. The electric motor 1004 may form part of the track drive 402 sub-circuit. The electric motor 1004 may receive electric power from the power unit 106 disposed within the main frame which is routed to the electric linear actuator by an electrical line. The electric motor 1004 may be controlled by the motor controller 312 which may be coupled to crawler assembly 1010, the leg assembly 1000, the pivot arm 106 the frame 102, and the like. In this regard, the leg assembly 1000 may include one or more electric motors which are used to rotate the tracks. Such rotation of the track section of the crawler assembly may then cause the paving machine 100 to be propelled in the direction of travel. The travel circuit may thus include a direct drive to the electric motor. Providing direct drive to the electric motor may be advantageous for providing accurate and precise speed control of the paving machine. The speed of the given track may then be controlled with a high level of precision, for coordinating each of the leg assemblies and causing the paving machine to follow a desired path with minimal deviation. Each leg assembly (e.g., two, three, or four leg assemblies) of the paving machine may include independent speed control based on the direct drive.

Although not depicted, the paving machine may include one or more motor controllers for controlling the power supplied to the motor 302, the electric slew drive 1006, and/or the electric motor 1004. It is further contemplated that each of the motor 302, the electric slew drive 1006, and the electric motor 1004 may include a separate motor controller. It is further contemplated that the paving machine 100 may include a primary motor controller.

A leg assembly is described in U.S. Pat. No. 9,764,762, titled "ROTARY PIVOT ARM POSITIONING ASSEMBLY", which is incorporated herein by reference in the entirety. A leg assembly is described in U.S. Pat. No. 11,254,359, "titled "LEG ASSEMBLY FOR CONSTRUCTION MACHINE", which is incorporated herein by reference in the entirety.

As depicted in FIG. 10, the track steer 404 sub-circuit, the track drive 404 sub-circuit, and the electric motor 302 are provided in parallel. For example, the track steer 404 sub-circuit, the track drive 404 sub-circuit, and the electric motor 302 may each be coupled in parallel to the circuit including the power unit 106, such as by a main power bus. Where the track steer 404 sub-circuit, the track drive 404 sub-circuit, and the electric motor 302 are provided in a parallel configuration on the circuit, each of the track steer 404 sub-circuit, the track drive 404 sub-circuit, and the electric motor 302 may further include a corresponding motor controller (not depicted). It is further contemplated that the track steer 404 sub-circuit, the track drive 404 sub-circuit, and the electric motor 302 may be coupled on separate circuits from a primary controller (not depicted).

Figure 11A:
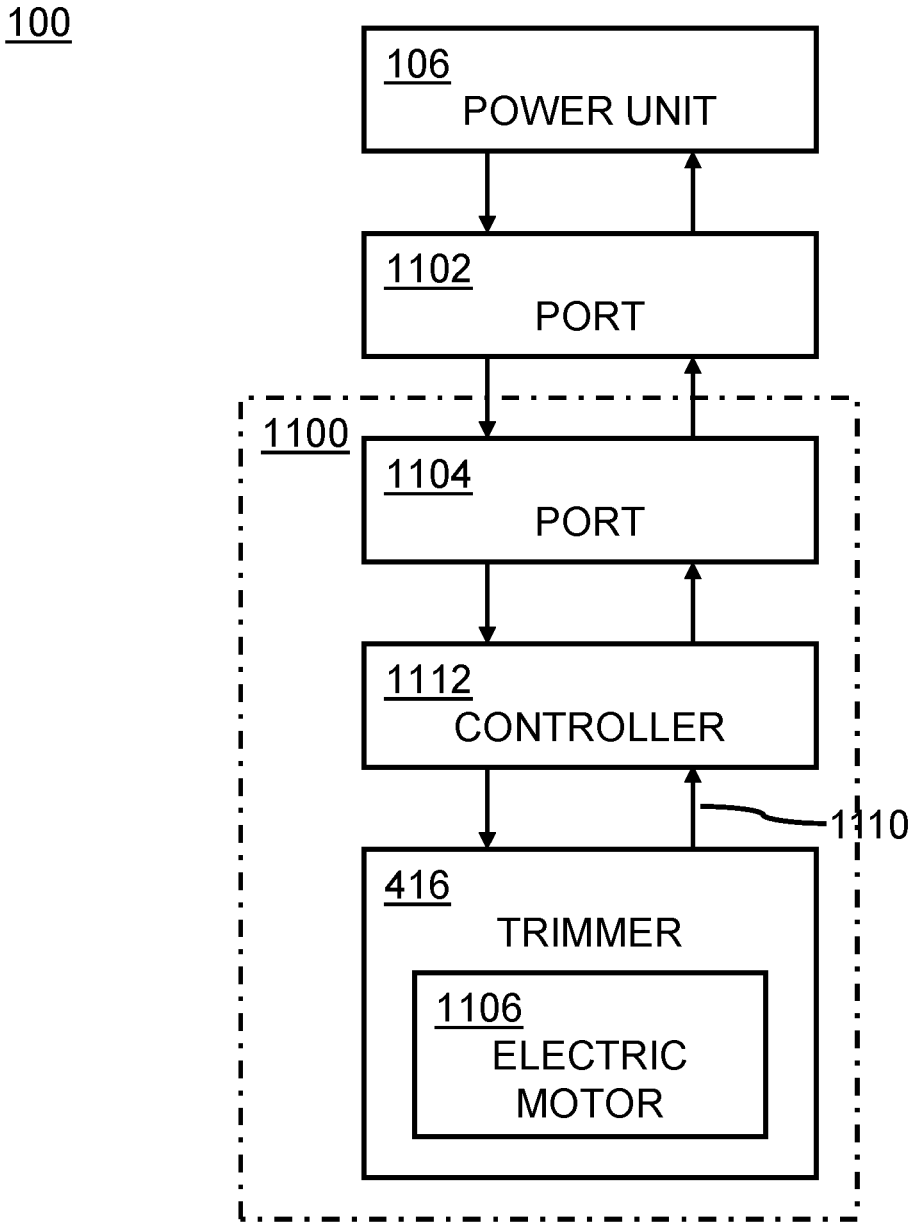
FIGS. 11A-11C depict a simplified block diagram of a trimmer attachment for a paving machine, in accordance with one or more embodiments of the present disclosure.
Figure 11B:
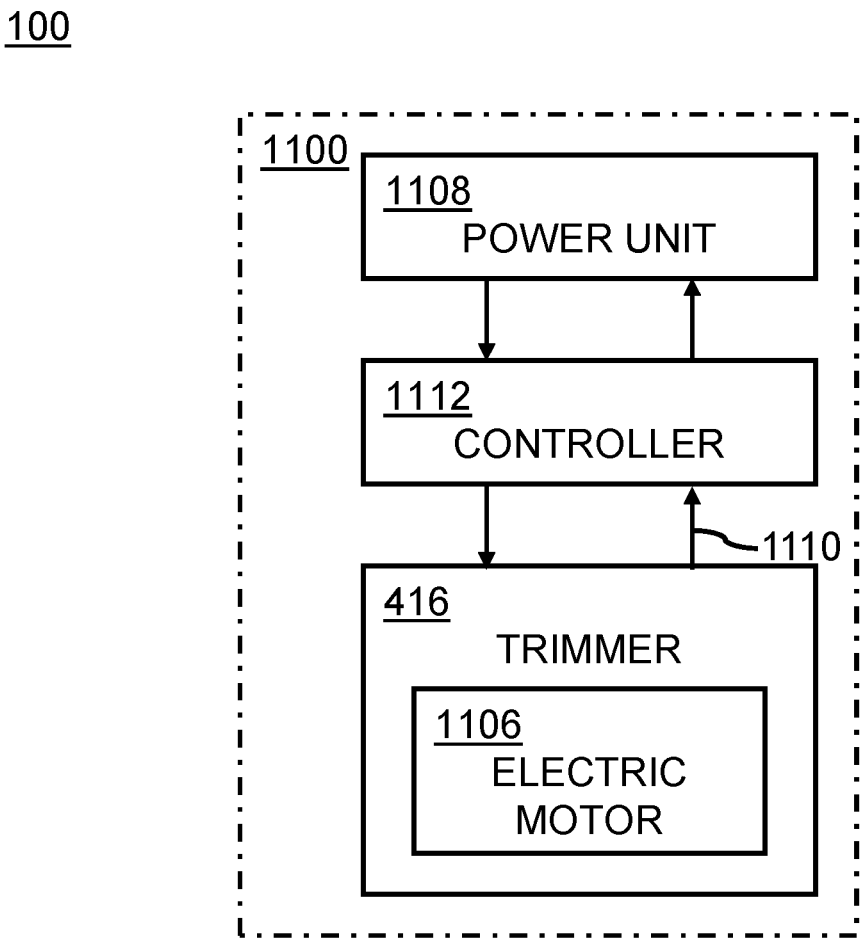
Figure 11C:
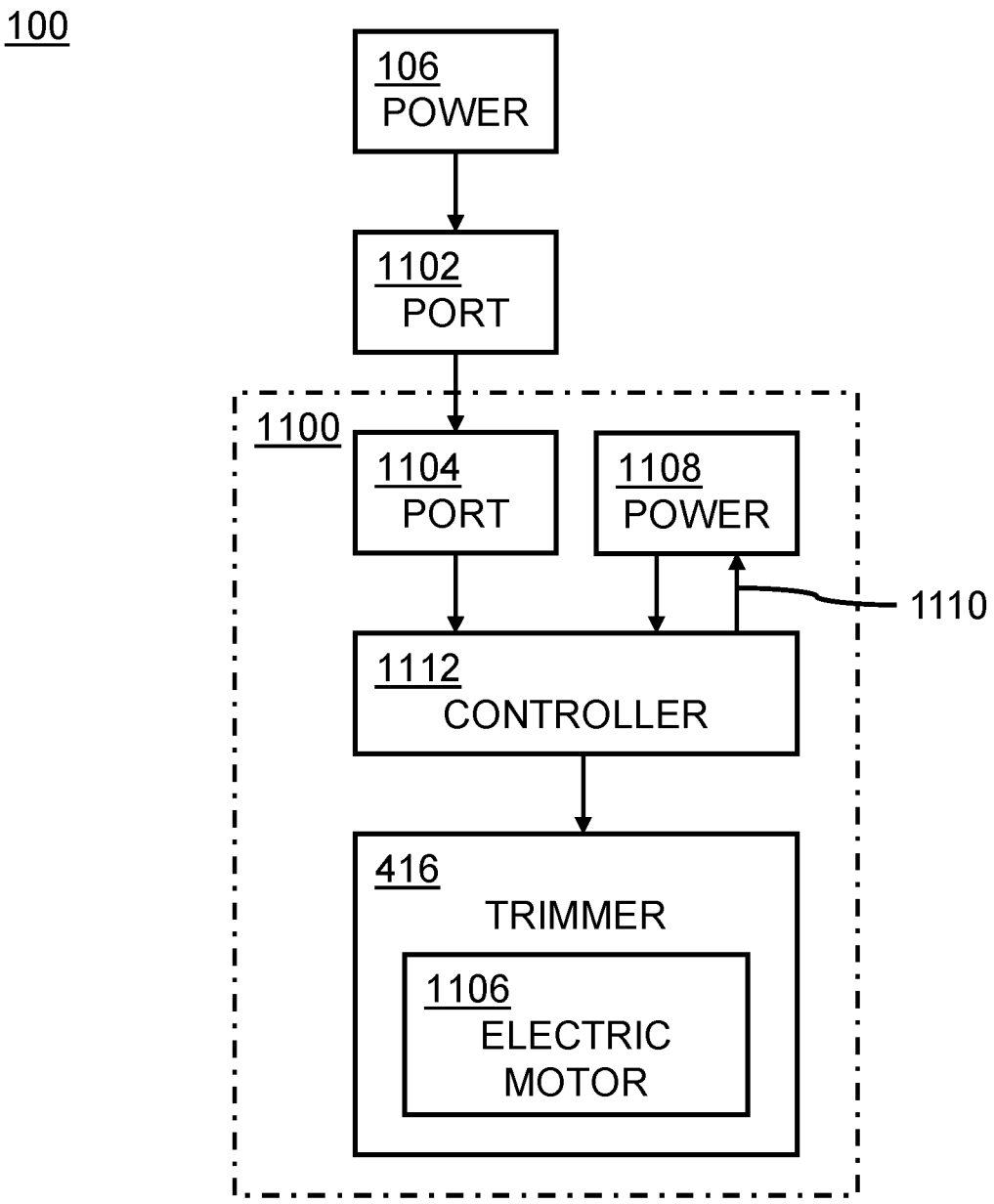

Referring generally to FIG. 11A-11C, an exemplary drivetrain for the paving machine 100 is described, in accordance with one or more embodiments of the present disclosure. The paving machine 100 may include one or more attachments, such as, but not limited to, a trimmer 1100, a dowel bar inserter, and the like. The attachment may include a portion of the drivetrain. The trimmer 1100 may include a trimmer sub-circuit with an electric motor 1106 configured to rotate a trimmer-head of the trimmer 1100. The rotation of the trimmer-head may thereby trim or mill a road surface. The trimmer 1100 may also include a motor controller 1112 configured to control the electric motor 1106 based on one or more signals from the controller 108 by a controller area network, although this is not intended to be limiting.

In embodiments, one or more components of the paving machine 100, such as the trimmer 1100, may regenerate electric power on ramp-down. The ramp-down may include gradually reducing power supplied to the components. As the components are ramped-down, kinetic energy of the component may be used to regenerate energy for storage and reuse. For example, the trimmer 1100 may be driven by the electric motor 1106 which causes the trimmer to rotate. To trim a grade on a surface, the trimmer-head may be spooled up and rotates. As the trimmer rotates, the trimmer-head mills the surface and places the material on a conveyor. Commonly, the conveyor then conveys the surface material to a dump truck. During operation, a command may be sent to slow or stop the trimmer-head. The trimmer-head may include a relatively high angular momentum which must be reduced to slow or stop the trimmer-head. In embodiments, regenerative braking (also referred to as dynamic braking) may be used to capture the rotational kinetic energy of the trimmer-head by the electric motor and store the energy in a battery for re-use. For example, when an emergency stop (e-stop) of the paving machine 100 is pressed, the electric motor 1106 may go from full power to zero power. The continued rotation of the trimmer-head may cause the electric motor 1106 to induce a flow 1110 of electricity. The flow 1110 induced by the electric motor 1106 may then be stored in an appropriate location, such as, but not limited to, a battery of the power unit 106, the power unit 1108, or another storage medium. For example, the trimmer 1100 may include a supercapacitor which may be configured to store the regenerated energy. The energy stored in the supercapacitor may then be provided to assist in powering the trimmer (e.g., to spool up or increase the speed of the trimmer head).

It is further contemplated that the trimmer 1100 may include an electric motor 302, the hydraulic pump 304, the reservoir 318, and a hydraulic motor (not depicted). However, the electric motor 1106 may be advantageous in removing efficiency losses. Providing the trimmer 416 sub-circuit as part of an electric drivetrain may be advantageous in removing efficiency losses associated with hydraulic pumping. Removing the efficiency loss of the hydraulic pump may be beneficial when running the trimmer circuit, given that the trimmer may require between half and three-fourths of the power of the paving machine at any given time.

Referring now to FIG. 11A, power may be supplied to the trimmer 1100 by a machine port 1102 located on the paving machine 100. The trimmer 1100 may also include an attachment port 1104 which may be plugged into the machine port 1102. In some instances, the machine port 1102 and/or the attachment port 1104 may be a quick-connect port. The trimmer 416 sub-circuit may be provided with power from the power unit 106 by way of the machine port 1102 and the attachment port 1104. In this regard, the trimmer 416 sub-circuit may be an electric powered trimmer. As may be understood, the recitations of machine port and attachment port is generally used to designate the location of the port, and is not intended to be limiting.

Referring now to FIG. 11B, although the trimmer 1100 is described as being plugged into the port, this is not intended to be limiting. In some instances, the trimmer 1100 may include a power unit 1108, such as a battery. Providing the attachment with the power unit 1108 may be advantageous for improving an interoperability of the paving machine 100 with any number of attachments. In this regard, the power unit 106 of the paving machine 100 may be sized to achieve the primary paving functions, and when the trimmer 1100 (or another attachment) is added the power unit 106 does not need to be replaced. Furthermore, a length of high-power cables (e.g., over 70 volts) running between power unit 106 and the trimmer 1100 may be removed. Reducing the length of the high-power cables may be advantageous in improving a safety of the paving machine, by reducing a likelihood of accidental electrification. For example, the attachment may be the trimmer 1100 which may include the power unit 1108 which is used to power the trimmer 416 sub-circuit.

Referring now to FIG. 11C, the trimmer 1100 may include both of the attachment port 1104 and the power unit 1108. During normal operation the power unit 106 (e.g., the generator and/or the battery) may supply power to the electric motor 1106. The power unit 1108 may be considered a secondary power unit to the power unit 106 which supplies power during peak loads. For example, the controller 108 and/or the machine controller 1112 may detect when the trimmer-head has become stuck. The trimmer-head may be detected as being stuck based on one or more signals received from a sensor (e.g., an encoder) of the electric motor 1106, or the like. The controller 108 and/or the machine controller 1112 may then cause the power unit 1108 (i.e., a battery of the power unit 1108) to supply additional power to the electric motor 1106, thereby causing the trimmer-head to become unstuck. Once the power unit 1108 is unstuck, power unit 106 may supply power as normal. Advantageously, the power unit 1108 together with the power unit 106 may allow for sufficient power during peak loading of the trimmer without requiring the power unit 106 to be sufficiently large during the peak loading, thereby allowing for reduced weight of the paving machine 100 when the trimmer attachment is detached. It is contemplated that the use of the diesel-battery power unit 106*c* together with the battery of the power unit 1108 may be advantageous. For example, the generator 204 of the power unit 106*c* may provide sufficient power when the trimmer is not engaged. When the trimmer is engaged, the battery 206 may be used to provide additional power during normal trimmer operations. When the trimmer is stuck, a smaller battery located on the trimmer may then be used to supply even more power. Such arrangement is beneficial in that an operator may reconfigure the power unit 106 without the battery 206 when not using the trimmer to save weight, then add the battery 206 while trimming. Additionally, the battery of the power unit 1108 may provide bursts of energy and regenerate power while minimally impacting a safety of a person located on the frame of the paving machine.

Referring generally again to FIGS. 1A-11C.

The paving machine 100 may include any suitable control mechanism for positioning the paving machine 100. For example, the paving machine 100 may include manual control steering and elevation. By way of another example, the paving machine 100 may include machine control by one or more control loops (e.g., by controller). In this regard, the paving machine 100 may include one or sensors (not depicted). The sensors may be used in machine distance calculations for various control loops. The sensors may generally include any sensor known in the art, such as, but not limited to, an encoder, a tachometer, a quadrature sensor, an absolute encoder, and the like.

In the case of a control algorithm, one or more program instructions or methods may be configured to operate via proportional control, feedback control, feedforward control, integral control, proportional-derivative (PD) control, proportional-integral (PI) control, proportional-integral-derivative (PID) control, or the like.

In embodiments, the framework of the paving machine may accommodate the various equipment described herein without modification. In embodiments, the framework of the paving machine may be redesigned to accommodate the various equipment described herein.

The various controllers described herein may include one or more processors or memory. Such processor may include any one or more processing elements known in the art. In this sense, the processor may include any microprocessor-type device configured to execute software algorithms and/or instructions. For example, the processor may consist of a mobile machine control computer, a desktop computer, mainframe computer system, workstation, parallel processor, or other computer system configured to execute a program configured to operate the paving machine 100, as described throughout the present disclosure. For the purposes of the present disclosure, the term "processor" or "processing element" may be broadly defined to encompass any device having one or more processing or logic elements (e.g., one or more micro-processor devices, one or more application specific integrated circuit (ASIC) devices, one or more field programmable gate arrays (FPGAs), or one or more digital signal processors (DSPs)). In this sense, the one or more processors may include any device configured to execute algorithms and/or instructions (e.g., program instructions stored in memory).

Similarly, the memory may include any storage medium known in the art suitable for storing program instructions executable by the processor. For example, the memory may include a non-transitory memory medium such as, but not limited to, a read-only memory (ROM), a random-access memory (RAM), a solid-state drive, and the like. It is further noted that memory may be housed in a common controller housing with the processor. The processor may be configured to receive the various information from the sensors by one or more controller area network buses. In one embodiment, the memory medium may be located remotely with respect to the physical location of the one or more processors.

All of the methods described herein may include storing results of one or more steps of the method embodiments in memory. The results may include any of the results described herein and may be stored in any manner known in the art. The memory may include any memory described herein or any other suitable storage medium known in the art. After the results have been stored, the results can be accessed in the memory and used by any of the method or system embodiments described herein, formatted for display to a user, used by another software module, method, or system, and the like. Furthermore, the results may be stored "permanently," "semi-permanently," temporarily," or for some period of time. For example, the memory may be random access memory (RAM), and the results may not necessarily persist indefinitely in the memory. It is further contemplated that each of the embodiments of the method described above may include any other step(s) of any other method(s) described herein. In addition, each of the embodiments of the method described above may be performed by any of the systems described herein.

One skilled in the art will recognize that the herein described components operations, devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components, operations, devices, and objects should not be taken as limiting.

As used herein, directional terms such as "top," "bottom," "front," "back," "over," "under," "upper," "upward," "lower," "down," and "downward" are intended to provide relative positions for purposes of description, and are not intended to designate an absolute frame of reference. Various modifications to the described embodiments will be apparent to those with skill in the art, and the general principles defined herein may be applied to other embodiments.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A paving machine comprising:

a frame;

a powertrain including:

a power unit coupled to the frame; wherein the power unit includes at least one of a generator or one or more batteries; and at least one of a hydraulic drivetrain or an electric drivetrain; wherein the at least one of the hydraulic drivetrain or the electric drivetrain is configured to receive electric power from the power unit; wherein the at least one of the hydraulic drivetrain or the electric drivetrain includes at least one sub-circuit which includes one or more actuators; wherein the one or more actuators include a hydraulic actuator; wherein the hydraulic drivetrain includes an electric motor, a hydraulic pump, one or more valves, and a hydraulic sub-circuit including the hydraulic actuator; wherein the electric motor is configured to receive the electric power from the power unit and cause the hydraulic pump to drive hydraulic fluid through the hydraulic sub-circuit;

a leg assembly; and a crawler assembly coupled to the leg assembly; wherein the crawler assembly is configured to propel the paving machine; wherein the leg assembly includes the hydraulic drivetrain; wherein the hydraulic sub-circuit includes a lift sub-circuit including a hydraulic cylinder configured to adjust a height of the leg assembly; wherein the electric motor and the hydraulic pump are disposed on the leg assembly above the hydraulic cylinder.

2. The paving machine of claim 1, further comprising a motor controller configured to adaptively control a rotational speed of the electric motor for supplying a desired flow rate of the hydraulic fluid together with a buffer; wherein the hydraulic drivetrain is configured to reclaim excess hydraulic power of the hydraulic fluid.

3. The paving machine of claim 1, wherein the one or more actuators include an electric actuator; wherein the electric drivetrain includes a motor controller and at least one electric sub-circuit including the electric actuator; wherein the motor controller is configured to control the electric actuator by controlling an amount of the electric power supplied to the at least one electric sub-circuit.

4. The paving machine of claim 3, wherein the motor controller is configured to reduce an amount of electric power supplied to the electric actuator in response to determining the electric actuator is stalled for preventing the electric actuator from overheating.

5. The paving machine of claim 3, wherein the crawler assembly includes a track section; wherein the at least one sub-circuit includes a track drive sub-circuit including an additional electric motor configured to turn the track section for propelling the paving machine.

6. The paving machine of claim 5, wherein the one or more electric sub-circuits further include a track steering sub-circuit including an electric slew drive configured to steer an angular position of the track section.

7. The paving machine of claim 1, wherein the power unit includes the generator and the one or more batteries; wherein the generator includes a diesel engine and an alternator.

8. The paving machine of claim 7, wherein the generator is a primary power source of the power unit and the one or more batteries are a secondary power source of the power unit for providing power when a trimmer is engaged.

9. The paving machine of claim 8, further comprising the trimmer including a trimmer sub-circuit, a motor controller, an additional battery, and a trimmer-head; wherein the trimmer sub-circuit includes an additional electric motor configured to rotate the trimmer-head; wherein the additional motor controller is configured to supply power from the additional battery to the additional electric motor in response to detecting a rotational speed of the additional electric motor is at or below a threshold indicating the trimmer-head is stalled.

10. The paving machine of claim 9, wherein the additional electric motor is configured to reduce a speed of the trimmer-head and to recharge at least one of the one or more batteries of the power unit or the additional battery of the trimmer by a regenerative braking.

11. The paving machine of claim 1, wherein the paving machine is at least one of a curb forming machine, a two-track slipform paver, a three-track slipform paver, a four-track slipform paver, a placing machine, a spreading machine, a trimming machine, a milling machine, a texturing machine, a finishing machine, or a bridge deck machine;

wherein the one or more sub-circuits includes at least one of a track drive sub-circuit, a track steer sub-circuit, a lift sub-circuit, a pivot arm steer sub-circuit, a vibrator sub-circuit, an auger sub-circuit, a conveyor sub-circuit, a trimmer sub-circuit, a frame extension sub-circuit, a mold shift sub-circuit, a dowel bar inserter sub-circuit, or a finisher sub-circuit.

12. A curb-forming machine comprising:

a frame;

a hopper coupled to the frame and configured to receive a material to be formed;

at least one crawler assembly supporting at least a portion of the frame, the at least one crawler assembly configured to propel the frame in a direction of travel;

an auger configured to convey the material from the hopper in a direction transverse to the direction of travel;

a mold configured to form the material into a curb;

one or more batteries configured to supply electric power;

one or more valves configured to measure a hydraulic flow provided to the auger and the at least one crawler assembly;

an electric motor;

a hydraulic pump configured to be driven by the electric motor, wherein the hydraulic pump generates the hydraulic flow in response to being driven by the electric motor; and a motor controller configured to receive the electric power from the one or more batteries and selectively engage the electric motor to drive the hydraulic pump based on the hydraulic flow measured by the one or more valves.

13. The curb-forming machine of claim 12, further comprising an electric vibrator configured to receive the electric power from the one or more batteries and vibrate to consolidate the material.

14. The curb-forming machine of claim 13, further comprising a first controller area network for signals to the motor controller and a second controller area network for signals to a vibrator controller; wherein the first controller area network is provided for isolating the electric motor.

15. The curb-forming machine of claim 12, wherein the motor controller is configured to control a rotational speed of the electric motor based on a flow rate of a hydraulic fluid through the one or more valves.

16. The curb-forming machine of claim 12, further comprising a standby mode; wherein the motor controller is configured to control a rotational speed of the electric motor at or above a stored value for a first duration after being put into the standby mode; wherein the stored value is greater than zero; wherein the motor controller is configured to reduce the revolutions per minute of the electric motor to zero after the first duration.

17. The curb-forming machine of claim 12, wherein the motor controller is configured to:

calculate a desired flow rate of a hydraulic fluid output by the hydraulic pump based on one or more inputs; wherein the one or more inputs include at least one of travel speed of the crawler assembly or an auger speed of the auger; wherein the desired flow rate includes a buffer;

receive feedback from at least one sensor of the curb-forming machine; wherein the at least one sensor indicates a spool position for a bank of valves, wherein the one or more valves is in the bank of valves; and control a rotational speed of the electric motor to output the desired flow rate of the hydraulic fluid based on the feedback from the at least one sensor; wherein the spool position for the bank of valves is summed to determine an actual hydraulic flow rate through the bank of valves which is used to control the rotational speed.

* * * * *